US006676774B2

(12) United States Patent
Matsuoka et al.

(10) Patent No.: US 6,676,774 B2
(45) Date of Patent: Jan. 13, 2004

(54) HOT ROLLED STEEL PLATE AND COLD ROLLED STEEL PLATE BEING EXCELLENT IN STRAIN AGING HARDENING CHARACTERISTICS

(75) Inventors: Saiji Matsuoka, Okayama (JP); Tetsuo Shimizu, Okayama (JP); Kei Sakata, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 09/980,300

(22) PCT Filed: Mar. 30, 2001

(86) PCT No.: PCT/JP01/02749

§ 371 (c)(1),
(2), (4) Date: Dec. 31, 2001

(87) PCT Pub. No.: WO01/77400

PCT Pub. Date: Oct. 18, 2001

(65) Prior Publication Data

US 2003/0111144 A1 Jun. 19, 2003

(30) Foreign Application Priority Data

| | | |
|---|---|---|
| Apr. 7, 2000 | (JP) | 2000-106340 |
| Apr. 10, 2000 | (JP) | 2000-107870 |
| Apr. 17, 2000 | (JP) | 2000-114933 |
| Sep. 20, 2000 | (JP) | 2000-286008 |
| Sep. 20, 2000 | (JP) | 2000-286009 |
| Sep. 29, 2000 | (JP) | 2000-299640 |

(51) Int. Cl.[7] ..... C22C 38/16; C22C 38/12; C22C 38/20; C22C 38/42; C22C 38/22

(52) U.S. Cl. ..... 148/328; 148/332; 148/333; 148/334; 148/335; 148/336; 148/320

(58) Field of Search ..... 148/332, 333, 148/334, 320, 328, 335, 336

(56) References Cited

U.S. PATENT DOCUMENTS

| | | | | |
|---|---|---|---|---|
| 4,502,897 A | * | 3/1985 | Morita et al. | 148/333 |
| 5,470,403 A | | 11/1995 | Yoshinaga et al. | |
| 5,558,727 A | * | 9/1996 | Miura et al. | 148/333 |
| 6,312,536 B1 | * | 11/2001 | Omiya et al. | 148/320 |

FOREIGN PATENT DOCUMENTS

| | | |
|---|---|---|
| DE | 693 29 236 T2 | 8/1994 |
| EP | 0 608 430 A1 | 8/1994 |
| JP | 6-81081 | 3/1994 |
| JP | 11-199975 | 7/1999 |
| JP | 11-343535 | 12/1999 |
| JP | 200-17385 | 1/2000 |
| KR | 97-1411 | 1/1997 |
| WO | WO 94/00615 | 1/1994 |

* cited by examiner

*Primary Examiner*—Deborah Yee
(74) *Attorney, Agent, or Firm*—Piper Rudnick LLP

(57) ABSTRACT

The present invention provides a steel sheet having a chemical composition comprising 0.15% or less C, 2.0% or less Si, 3.0% or less Mn, P, S, Al and N in adjusted amounts, from 0.5 to 3.0% Cu, or one or more of Cr, Mo and W in a total amount of 2.0% or less, and having a composite structure comprising ferrite and martensite having an area ratio of 2% or more. The steel sheet is in the form of a high-strength hot-rolled steel sheet, a high-strength cold-rolled steel sheet, or a hot-dip galvanized steel sheet. There is thus available a steel sheet excellent in press-formability and in strain age hardening property as represented by a ΔTS of 80 MPa or more.

11 Claims, 6 Drawing Sheets

HOT ROLLED STEEL PLATE AND COLD ROLLED STEEL PLATE BEING EXCELLENT IN STRAIN AGING HARDENING CHARACTERISTICS

TECHNICAL FIELD

The present invention relates mainly to steel sheets for automobile, and more particularly, to steel sheets having a very high strain age hardening property, excellent in press-formability such as bending workability, stretch-flanging workability, and drawing workability, in which tensile strength increases considerably through a heat treatment after press forming, and manufacturing methods thereof. The term "steel sheets" as herein used shall include hot-rolled steel sheets, cold-rolled steel sheets, and plated steel sheets.

BACKGROUND ART

Weight reduction of automobile bodies has become in recent years a very important issue in relation to emission control for the purpose of preserving global environments. More recently, efforts are made to achieve a higher strength of automotive steel sheets and reduce steel sheet thickness.

Because many of the body parts of automobile made of steel sheets are formed by press-working, steel sheets used are required to have an excellent press-formability. In order to achieve an excellent press-formability, it is necessary to ensure a low yield strength and a high elongation. Stretch-flanging may be frequently applied in some cases, so that it is also necessary to have a high hole-expanding ratio. In general, however, a higher strength of steel sheet leads to an increase in yield strength and deterioration of shape freezability, and tends to result in a lower elongation and a poorer hole-expanding ratio, thus leading to a lower press-formability. As a result, there as conventionally been an increasing demand for high-strength hot-rolled steel sheets, high-strength cold-rolled steel sheets and high-strength plated steel sheets having high elongation and excellent in press-formability.

Importance is now placed on safety of automobile body to protect a driver and passengers upon collision, and for this purpose, steel sheets are demanded to have an improved impact resistance as a standard of safety upon collision. For the purpose of improving impact resistance, a higher strength in a completed automobile is more favorable. There has therefore been the strongest demand for high-strength hot-rolled steel sheets, high-strength cold-rolled steel sheets and high-strength plated steel sheets having a low strength and a high elongation and excellent in press-formability upon forming automobile parts, and having a high strength and excellent in impact resistance in completed products.

To satisfy such a demand, a steel sheet high both in press-formability and strength was developed. This is a baking hardening type steel sheet of which yield stress increases by applying a baking treatment usually including holding at a high temperature of 100 to 200° C. after press forming. This steel sheet is based on a process comprising the steps of controlling the content of C remaining finally in a solid-solution state (solute C content) within an appropriate range, keeping mildness, satisfactory shape freezability and elongation during press forming, preventing movement of dislocation introduced during press forming by the residual solute C fixed to it during the baking treatment after press forming, thereby causing an increase in yield stress. However, in this baking hardening type automotive steel sheet, while yield stress can be increased, it was impossible to increase tensile strength.

Japanese Examined Patent Application Publication No. 5-24979 discloses a baking hardening high-strength cold-rolled steel sheet having a chemical composition comprising from 0.08 to 0.20% C, from 1.5 to 3.5% Mn and the balance Fe and incidental impurities, and having a structure composed of uniform bainite containing up to 5% ferrite or bainite partially containing martensite. The cold-rolled steel sheet disclosed in Japanese Examined Patent Application Publication No. 5-24979 has an object to achieve a high baking hardening amount conventionally unavailable through conversion of structure from the conventional structure mainly comprising ferrite into a structure mainly comprising bainite, by rapidly cooling the steel sheet after continuous annealing within a temperature range of from 400 to 200° C. in the cooling step and then slowly cooling the same. In the steel sheet disclosed in Japanese Examined Patent Application Publication No. 5-24979, however, while a high baking hardening amount conventionally unavailable is obtained through an increase in yield strength after baking, it is yet impossible to increase tensile strength, and there still remains a problem in that improvement of impact resistance cannot be expected.

On the other hand, several hot-rolled steel sheets are proposed with a view to increasing not only yield stress but also tensile strength by applying a heat treatment after press forming.

For example, Japanese Examined Patent Application Publication No. 8-23048 proposes a manufacturing method of a hot-rolled steel sheet, comprising the steps of reheating a steel containing from 0.02 to 0.13% C, up to 2.0% Si, from 0.6 to 2.5% Mn, up to 0.10% sol. Al, and from 0.0080 to 0.0250% N to a temperature of at least 1,100° C., applying a hot rolling end finish rolling at a temperature of from 850 to 950° C., then cooling the hot-rolled steel sheet at a cooling rate of at least 15° C./second to a temperature of under 150° C., and coiling the same, thereby achieving a composite structure mainly comprising ferrite and martensite. In the steel sheet manufactured by the technique disclosed in Japanese Examined Patent Application Publication No. 8-23048, however, while tensile strength is increased, together with yield stress, by strain age hardening, a serious problem is posed in that coiling of the steel sheet at a very low coiling temperature as under 150° C. results in large dispersions of mechanical properties. Another problems include large dispersions of increment of yield stress after press forming and baking treatments, as well as an insufficient press-formability resulting from a low hole-expanding ratio ($\lambda$) and a decreased stretch-flanging workability.

On the other hand, for some portions, automotive parts are required to have a high corrosion resistance. A bot-dip galvanized steel sheet is suitable as a material applied to portions required to have a high corrosion resistance, and a particular demand exists for hot-dip galvanized steel sheets excellent in press-formability during forming, and is considerably hardened by a heat treatment after forming.

To respond to such a demand, for example Japanese Patent Publication No. 2802513 proposes a manufacturing method of a hot-dip galvanized steel sheet using a hot-rolled steel sheet as a substrate. The patented method comprises the steps of hot-rolling a steel slab containing up to 0.05% C, from 0.05 to 0.5% Mn, up to 0.1% Al and from 0.8 to 2.0% Cu under conditions including a coiling temperature of up to 530° C., reducing the steel sheet surface by heating the hot-rolled steel sheet to a temperature of up to 530° C., and hot-dip-galvanizing the sheet, whereby a remarkable hardening is available through a heat treatment after forming. In the steel sheet manufactured by this method, however, in order to obtain a remarkable hardening from the heat treatment after forming, the heat treatment temperature must be at least 500° C., and this has posed a problem in practice.

Japanese Unexamined Patent Application Publication No. 10-310824 proposes a manufacturing method of an alloyed hot-dip galvanized steel sheet permitting expectation of an increase in strength through a heat treatment after forming, using a hot-rolled or cold-rolled steel sheet as a substrate. This method comprises the steps of hot-rolling a steel containing from 0.01 to 0.08% C, appropriate amounts of Si, Mn, P, S, Al and N, and one or more of Cr, W and Mo in a total amount of from 0.05 to 3.0%, or cold-rolling or temper-rolling the sheet and annealing the same, applying hot-dip galvanizing the sheet, and then, conducting a heating/alloying treatment. The Publication asserts that, after forming, tensile strength is increased by heating the sheet at a temperature within a range of from 200 to 450° C. However, the resultant steel sheet involves a problem in that, because the microstructure comprises a ferrite single phase, a ferrite+pearlite, or a ferrite+bainite structure, a high elongation and a low yield strength are unavailable, resulting in a low press-formability.

Japanese Unexamined Patent Application Publication No. 11-199975 proposes a hot-rolled steel sheet for working excellent in fatigue property, containing from 0.03 to 2.0% C, appropriate amounts of Si, Mn, P, S and Al, from 0.2 to 2.0% Cu, and from 0.0002 to 0.002% B, of which the microstructure is a composite structure having ferrite as a main phase and martensite as the second phase, and the state of presence of Cu in the ferrite phase in a solid-solution state and/or precipitation of up to 2 nm. The proposed steel sheet has an object based on a fact that fatigue limit ratio is remarkably improved only when compositely adding Cu and B, and achieving the finest state of Cu as up to 2 nm. For this purpose, it is essential to end hot finish rolling at a temperature of at least the $Ar_3$ transformation point, air-cool the sheet within a temperature region of from $Ar_3$ to $Ar_1$ in cooling for a period of from 1 to 10 seconds, then cool the sheet at a cooling rate of at least 20° C./second, and coil the cooled sheet at a temperature of up to 350° C. A low coiling temperature of up to 350° C. poses a problem of causing a serious deformation of the shape of the hot-rolled steel sheet, thus preventing industrially stable manufacture.

DISCLOSURE OF INVENTION

The present invention was developed in view of the fact that, in spite of the strong demand as described above, a technique for industrially stably manufacturing a steel sheet satisfying these properties has never been proposed, and has an object to favorably solve the problems described above and to provide a high-strength steel sheet suitable as an automotive steel sheet, having an excellent press-formability, and excellent in strain age hardening property causing tensile strength to increase considerably through a heat treatment at a relatively low temperature after press-forming, and a manufacturing method permitting stable production of such a high-strength steel sheet. The term "steel sheets" as herein used shall include hot-rolled steel sheets, cold-rolled steel sheets and plated steel sheets.

To achieve the above-mentioned object of the invention, the present inventors carried out extensive studies on the effect of the steel sheet structure and alloying elements on strain age hardening property. As a result, the following findings were obtained. It is possible to obtain a high strain age hardening bringing about an increase in yield stress, and in addition, a remarkable increase in tensile strength, after application of a pre-strain treatment of an amount of pre-strain of 5% or more and a heat treatment at a relatively low temperature within a range of from 150 to 350° C. There is thus available a steel sheet having a satisfactory elongation, a low yield strength and a high hole expanding ratio, and excellent in press-formability.

On the basis of the novel findings as described above, the present inventors carried out further extensive studies and found that the above-mentioned phenomenon occurred in steel sheets not containing Cu as well. When a prestrain is imparted by using a steel sheet containing one or more of Mo, Cr and W in place of Cu, and achieving a ferrite+martensite composite structure, and a heat treatment was applied at a low temperature, very fine carbides were formed to strain-induced-precipitate in martensite, resulting in an increase in tensile strength. The strain-induced precipitation upon heating to a low temperature was found to become more remarkable by containing one or more of Nb, V and Ti, in addition to one or more of Mo, Cr and W.

The present invention was completed through further studies on the basis of the aforementioned findings. The gist of the invention is as follows:

(1) A steel sheet excellent in press-formability and in strain age hardening property as typically represented by a ΔTS of 80 MPa or more, comprising a structure having ferrite phase as a main phase forming a composite structure with a secondary phase containing martensite phase in an area ratio of 2% or more.

(2) A steel sheet excellent in press-formability and in strain age hardening property as typically represented by a ΔTS of 80 MPa or more as in (1) above, wherein the steel sheet is a hot-rolled steel sheet.

(3) A steel sheet according to (2) above, excellent in press-formability and in strain age hardening property as typically represented by a ΔTS of 80 MPa or more, comprising, in weight percentage: 0.15% or less C, 2.0% or less Si, 3.0% or less Mn, 0.1% or less P, 0.02% or less S, 0.1% or less Al, 0.02% or less N, from 0.5 to 3.0% Cu and the balance Fe and incidental impurities.

(4) A steel sheet according to (3) above, containing, in weight percentage, one or more selected from the following groups A to C, in addition to the above-mentioned chemical composition:

group A: Ni: 2.0% or less;

group B: one or two of Cr and Mo: 2.0% or less in total; and group C: one or more of Nb, Ti and V: 0.2% or less in total.

(5) A steel sheet according to (2) above, excellent in press-formability and in strain age hardening property as typically represented by a ΔTS of 80 MPa or more, having a chemical composition comprising, in weight percentage: 0.15% or less C, 2.0% or less Si, 3.0% or less Mn, 0.1% or less P, 0.02% or less S, 0.1% or less Al, 0.02% or less N, one or more selected from the group consisting of from 0.05 to 2.0% Mo, from 0.05 to 2.0% Cr and from 0.05 to 2.0% W, 2.0% or less in total, and the balance Fe and incidental impurities.

(6) A steel sheet according to (5) above, excellent in press-formability and in strain age hardening property as typically represented by a ΔTS of 80 MPa or more, further comprising, in addition to the above-mentioned chemical composition, in weight percentage, one or more selected from the group consisting of Nb, Ti, and V, 2.0% or less in total.

(7) A manufacturing method of a steel sheet excellent in press-formability and in strain age hardening property as typically represented by a ΔTS of 80 MPa or more, comprising the steps, when hot-rolling a steel slab having a chemical composition comprising, in weight percentage, 0.15% or less C, 2.0% or less Si, 3.0% or less Mn, 0.1% or less P, 0.02% or less S, 0.1% or less Al, 0.02% or less N, and from 0.5 to 3.0% Cu, or additionally containing one or more selected from the following groups A to C:

group A: Ni: 2.0% or less;

group B: one or two of Cr and Mo: 2.0% or less in total; and group C: one or more of Nb, Ti and V: 0.2% or less in total, and preferably the balance Fe and incidental impurities, into a hot-rolled steel sheet having a prescribed thickness, carrying out the hot rolling with a finish rolling end temperature FDT of the $Ar_3$ transformation point or more, then after the completion of the finish rolling, cooling the hot-rolled steel sheet to a temperature region from the ($Ar_3$ transformation point) to the ($Ar_1$ transformation point) at a cooling rate of 5° C./second or more, air-cooling or slowly cooling the sheet within the temperature region for a period of from 1 to 20 seconds, then cooling the sheet again at a cooling rate of 5° C./second or more, and coiling the sheet at a temperature of 550° C. or below.

(8) A manufacturing method of a hot-rolled steel sheet excellent in press-formability and in strain age hardening property as typical represented by a ΔTS of 80 MPa or more, according to (6) above, wherein the steel slab has a chemical composition containing, in weight percentage, 0.15% or less C, 2.0% or less Si, 3.0% or less Mn, 0.1% or less P, 0.02% or less S, 0.1% or less Al, 0.02% or less N, and further containing one or more selected from the group consisting of from 0.05 to 2.0% Mo, from 0.05 to 2.0% Cr, and from 0.05 to 2.0% W, 2.0% or less in total, or further containing one or more selected from the group consisting of Nb, Ti and V, in an amount of 2.0% or less in total, and preferably, the balance Fe and incidental impurities.

(9) A manufacturing method of a hot-rolled steel sheet excellent in press-formability and in strain age hardening property as typically represented by a ΔTS of 80 MPa or more, according to (7) or (8) above, wherein all or part of the finish rolling comprises lubrication rolling.

(10) A steel sheet excellent in press-formability and in strain age hardening property as typically represented by a ΔTS of 80 MPa or more, according to (1) above, which is a cold-rolled steel sheet.

(11) A steel sheet excellent in press-formability and in strain age hardening property as typically represented by a ΔTS of 80 MPa or more, according to (10) above, comprising, in weight percentage, 0.15% or less C, 2.0% or less Si, 3.0% or less Mn, 0.1% or less P, 0.02% or less S, 0.1% or less Al, 0.02% or less N, from 0.5 to 3.0% Cu, and the balance Fe and incidental impurities.

(12) A steel sheet excellent in press-formability and in strain age hardening property as typically represented by a ΔTS of 80 MPa or more, according to (11) above, containing, in weight percentage, one or more selected from the following groups A to C, in addition to the above-mentioned chemical composition:

group A: Ni: 2.0% or less;

group B: one or two of Cr and Mo: 2.0% or less in total; and group C: one or more of Nb, Ti and V: 0.2% or less in total.

(13) A steel sheet excellent in press-formability and in strain age hardening property as typically represented by a ΔTS of 80 MPa or more, according to (10) above, having a chemical composition comprising, in weight percentage, in addition to the above-mentioned chemical composition, 0.15% or less C, 2.0% or less Si, 3.0% or less Mn, 0.1% or less P, 0.02% or less S, 0.1% or less Al, 0.02% or less N, one or more selected from the group consisting of from 0.05 to 2.0% Mo, from 0.05 to 2.0% Cr and from 0.05 to 2.0% W, 2.0% or less in total, and the balance Fe and incidental impurities.

(14) A steel sheet excellent in press-formability and in strain age hardening property as typically represented by a ΔTS of 80 MPa or more, according to (13) above, further comprising, in addition to the above-mentioned chemical composition, in weight percentage, one or more selected from the group consisting of Nb, Ti and V, 2.0% or less in total.

(15) A manufacturing method of a cold-rolled steel sheet excellent in press-formability and in strain age hardening property as typically represented by a ΔTS of 80 MPa or more, comprising the steps of using a steel slab having a chemical composition containing, in weight percentage, 0.15% or less C, 2.0% or less Si, 3.0% or less Mn, 0.1% or less P, 0.02% or less S, 0.1% or less Al, 0.02% or less N, and from 0.5 to 3.0% Cu, or further containing one or more selected from the following groups A to C:

group A: Ni: 2.0% or less;

group B: one or two of Cr and Mo: 2.0% or less in total; and group C: one or more of Nb, Ti and V: 0.2% or less in total, and preferably, the balance Fe and incidental impurities as a material; a hot rolling step of applying hot rolling to the material into a hot-rolled steel sheet; a cold rolling step of applying cold rolling to the hot-rolled steel sheet into a cold-rolled steel sheet; and a recrystallization annealing step of applying recrystallization annealing into a cold-rolled annealed steel sheet; these steps being sequentially applied; wherein the recrystallization annealing is conducted in a ferrite+austenite dual phase region within a temperature range of from $Ac_1$ transformation point to $Ac_3$ transformation point.

(16) A manufacturing method of a cold-rolled steel sheet excellent in press-formability and in strain age hardening property as typically represented by a ΔTS of 80 MPa or more, according to (15) above, wherein the steel slab has a chemical composition containing, in weight percentage, 0.15% or less C, 2.0% or less Si, 3.0% or less Mn, 0.1% or less P, 0.02% or less S, 0.1% or less Al, 0.02% or less N, and further containing one or more selected from the group consisting of from 0.05 to 2.0% Mo, from 0.05 to 2.0% Cr, and from 0.05 to 2.0% W, or further containing one or more of Nb, Ti and V, 2.0% or less in total, and preferably, the balance Fe and incidental impurities.

(17) A manufacturing method of a cold-rolled steel sheet excellent in press-formability and in strain age hardening property as typically represented by a ΔTS of 80 MPa or more, according to (15) or (16) above, wherein the hot rolling is conducted under conditions including a heating temperature of the material of 900° C. or more, a finish rolling end temperature of 700° C. or more, and a coiling temperature of 800° C. or below.

(18) A manufacturing method of a cold-rolled steel sheet excellent in press-formability and in strain age hardening property as typically represented by a ΔTS of 80 MPa or more, according to any one of (15) to (17) above, wherein all or part of the hot rolling comprises lubrication rolling.

(19) A hot-dip galvanized steel sheet excellent in press-formability and in strain age hardening property as typically represented by a ΔTS of 80 MPa or more, comprising a hot-dip galvanizing layer or an alloyed hot-dip galvanizing layer formed on the surface of the hot-rolled steel sheet according to any one of (2) to (6) above.

(20) A hot-dip galvanized steel sheet excellent in press-formability and in strain age hardening property as typically represented by a ΔTS of 80 MPa or more, comprising a hot-dip galvanizing layer or an alloyed hot-dip galvanizing layer formed on the surface of the cold-rolled steel sheet according to any one of (10) to (14) above.

(21) A manufacturing method of a hot-dip galvanized steel sheet excellent in press-formability and in strain age hardening property as typically represented by a ΔTS of 80 MPa or more, comprising the steps of using a steel sheet having a chemical composition containing, in weight percentage, 0.15% or less C, 2.0% or less Si, 3.0% or less Mn, 0.1% or less P, 0.02% or less S, 0.1% or less Al, 0.02% or less N, and from 0.5 to 3.0% Cu, or further containing one or more selected from the following groups:

group A: 2.0% or less Ni;

group B: one or two of Cr and Mo: 2.0% or less in total; and group C: one or more of Nb, Ti and V: 0.2% or less in total, preferably the balance Fe and incidental impurities, applying annealing comprising heating to a dual phase region of ferrite+austenite within a temperature range of from $Ac_3$ transformation point to $Ac_1$ transformation point to the steel sheet on a line for conducting continuous hot-dip galvanizing, and then, performing a hot-dip galvanizing treatment, thereby forming a hot-dip galvanizing layer on the surface of the steel sheet.

(22) A manufacturing method of a hot-dip galvanized steel sheet excellent in press-formability and in strain age hardening property as typically represented by a ΔTS of 80 MPa or more, according to (21) above, wherein the steel sheet is replaced by a steel sheet having a chemical composition containing, in weight percentage, 0.15% or less C, 2.0% or less Si, 3.0% or less Mn, 0.1% or less P, 0.02% or less S, 0.1% or less Al, and 0.02% or less N, and further comprising one or more selected from the group consisting of from 0.05 to 2.0% Mo, from 0.05 to 2.0% Cr and from 0.05 to 2.0% W, 2.0% or less in total, or further containing one or more of Nb, Ti and V in an amount of 2.0% or less in total, preferably the balance Fe and incidental impurities.

(23) A manufacturing method of a hot-dip galvanized steel sheet excellent in press-formability and in strain age hardening property as typically represented by as ΔTS of 80 MPa or more, according to (21) or (22) above, wherein, prior to the annealing, a preheating treatment of heating the sheet at a temperature of 700° C. or more on a continuous annealing line, and then applying a pretreatment comprising a pickling treatment.

(24) A manufacturing method of a hot-dip galvanized steel sheet excellent in press-formability and in strain age hardening property as typically represented by a ΔTS of 80 MPa or more, according to any one of (21) to (23) above, comprising the steps of conducting the hot-dip galvanizing treatment to form a hot-dip galvanizing layer on the surface of the steel sheet, and then, performing an alloying treatment of the hot-dip galvanizing layer.

(25) A manufacturing method of a hot-dip galvanized steel sheet excellent in press-formability and in strain age hardening property as typically represented by a ΔTS of 80 MPa or more, according to any one of (21) to (24) above, wherein the steel sheet is a hot-rolled steel sheet manufactured by hot-rolling the material having the chemical composition under conditions including a heating temperature of 900° C. or more, a finish rolling end temperature of 700° C. or more and a coiling temperature of 800° C. or below, or a cold-rolled steel sheet obtained by cold-rolling the hot-rolled steel sheet.

(26) A manufacturing method of a hot-dip galvanized steel sheet excellent in press-formability and in strain age hardening property as typically represented by a ΔTS of 80 MPa or more, further comprising a step of applying a hot-dip galvanizing treatment to the hot-rolled steel sheet resulting from the manufacturing method of a hot-rolled steel sheet according to any one of (7) to (9) above to form a hot-dip galvanizing layer on the surface of the hot-rolled steel sheet.

(27) A manufacturing method of a hot-dip galvanized steel sheet excellent in press-formability and in strain age hardening property as typically represented by a ΔTS of 80 MPa or more, further comprising a step of applying a hot-dip galvanizing treatment to the cold-rolled steel sheet resulting from the manufacturing method of a cold-rolled steel sheet according to any one of (15) to (18) above to form a hot-dip galvanizing layer on the surface of the cold-rolled steel sheet.

(28) A manufacturing method of a hot-dip galvanized steel sheet excellent in press-formability and in strain age hardening property as typically represented by a ΔTS of 80 MPa or more, according to any one of (26) and (27) above, further comprising the step of carrying out an alloying treatment after the hot-dip galvanizing treatment.

BEST MODE FOR CARRYING OUT THE INVENTION

Figure 1:
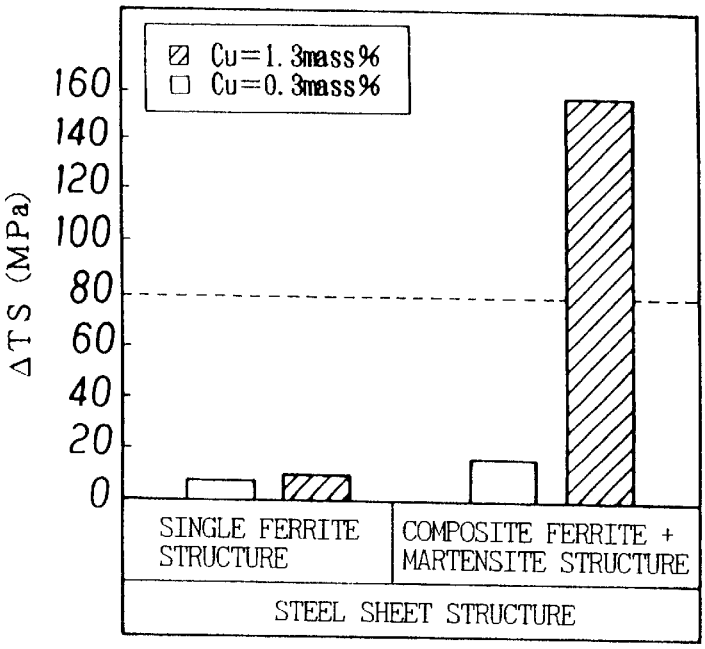
FIG. 1 is a graph illustrating the effect of the Cu content on the relationship between ΔTS and the (hot-rolled) steel sheet structure after a pre-strain—heat treatment.

The term "being excellent in strain age hardening property" shall mean that, when a steel sheet is subjected to a pre-strain treatment of an amount of tensile plastic strain of 5% or more, and then, to a heat treatment at a temperature within a range of from 150 to 350° C. for a holding time of 30 seconds or more, the increment ΔTS in tensile strength between before and after the heat treatment {=(tensile strength after heat treatment)−(tensile strength before pre-strain treatment)} is 80 MPa or more, or ΔTS should preferably be 100 MPa or more. It is needless to mention that the heat treatment causes an increase in yield stress, bringing about a ΔYS of 80 MPa or more. The term ΔYS means an increment of yield strength from before to after the heat treatment, and is defined as ΔYS={(yield strength after heat treatment)−(yield strength before pre-strain treatment)}.

When regulating the strain age hardening property, the amount of pre-strain plays an important role. The present inventors investigated the effect of the amount of prestrain on the subsequent strain age hardening property by assuming types of deformation to which automotive steel sheets are subjected. The resultant findings included the possibility to arrange data in terms of uniaxial equivalent strain (tensile strain) except for a very deep drawing, that the uniaxial equivalent strain amount substantially accounts for more than 5% for actual parts, and that the parts strength exhibits a good agreement with the strength available after a strain aging treatment of a prestrain of 5%. Considering these findings, the prestrain (deformation) of a strain aging treatment is assumed to give a tensile plastic strain of 5% or more in the present invention.

The conventional baking treatment conditions include 170° C.×20 minutes as standards. When using precipitation strengthening of very fine Cu as in the present invention, a heat treatment temperature of 150° C. or more is necessary. Under conditions including a temperature of over 350° C., on the other hand, the effect is saturated, and even a tendency toward softening is exhibited. Heating to a temperature of over 350° C. causes marked occurrence of thermal strain or temper color. For these reasons, a heat treatment temperature range of from 150 to 350° C. is adopted for strain age hardening in the invention. The holding time of the heat treatment temperature should be 30 seconds or more. Holding a heat treatment temperature within a range of from 150 to 350° C. for about 30 seconds permits achievement of substantially sufficient strain age hardening. When desiring a more stable strain age hardening, the holding time should preferably be 60 seconds or more, or more preferably, 300 seconds or more.

While no particular restriction is imposed on the aforementioned heating method in the heat treatment, atmospheric heating in a furnace, as well as induction heating, and heating by non-oxidizing flame, a laser or plasma are suitably applicable. So-called hot pressing for pressing a steel sheet while heating the same is very effective means in the present invention.

The result of a fundamental experiment carried out by the present inventors on hot-rolled steel sheets will first be described.

A sheet bar having a chemical composition containing, in weight percentage, 0.04% C, 0.82% Si, 1.6% Mn, 0.01% P, 0.005% S, 0.04% Al and 0.002% N, with Cu varying to 0.3% and 1.3% was heated to 1,150° C. and soaked at this temperature, subjected to three-pass rolling to a thickness of 2.0 mm so as to achieve a finish rolling end temperature of 850° C., and converted from a single ferrite structure steel sheet into a hot-rolled steel sheet having a composite ferrite+martensite structure by changing cooling conditions and the coiling temperature.

Tensile property was investigated through a tensile test on these hot-rolled steel sheets. A pre-strain treatment of a tensile prestrain of 5% was applied to test pieces sampled from these hot-rolled steel sheets. Then, after applying a heat treatment at 50 to 350° C. for 20 minutes, a tensile test was carried out to determine tensile property, and the strain age hardening property was evaluated.

The strain age hardening property was evaluated in terms of the increment ΔTS of tensile strength from before to after the heat treatment. The term ΔTS is herein defined as a difference between tensile strength $TS_{HT}$ after heat treatment and tensile strength TS when no heat treatment is applied {=(tensile strength $TS_{HT}$ after heat treatment)−(tensile strength TS before pre-strain treatment)}. The tensile test was carried out by using JIS #5 tensile test pieces.

FIG. 1 illustrates the effect of the Cu content on the relationship between ΔTS and the steel sheet (hot-rolled steel sheet) structure. The value of ΔTS was determined by conducting a pre-strain treatment of a tensile prestrain of 5% on the test pieces, and then, applying a heat treatment of 250° C.×20 minutes. It is suggested from FIG. 1 that, for a Cu content of 1.3 wt. %, a high strain age hardening property as represented by a ΔTS of 80 MPa or more is available by achieving a composite ferrite+martensite steel sheet structure. In the case of a Cu content of 0.3 wt. %, ΔTS is under 80 MPa, and a high strain age hardening property cannot be obtained even by achieving a composite ferrite+martensite steel sheet structure.

It is possible to manufacture a hot-rolled steel sheet having a high strain age hardening property by limiting the Cu content within an appropriate range, and achieving a composite ferrite+martensite structure.

Figure 2:
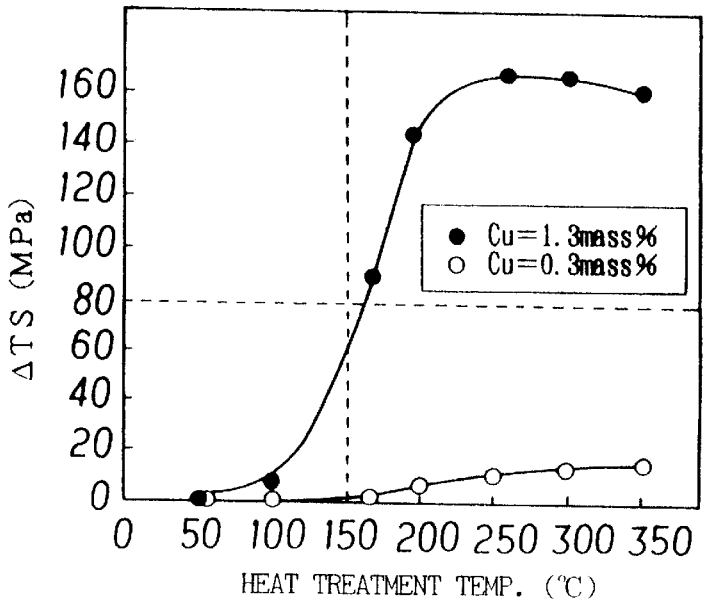
FIG. 2 is a graph illustrating the effect of the Cu content on the relationship between ΔTS and the heat treatment temperature after a pre-strain—heat treatment of a hot-rolled steel sheet.

FIG. 2 illustrates the effect of the Cu content on the relationship between ΔTS and the heat treatment temperature after pre-strain treatment. The hot-rolled sheet used was prepared by cooling the sheet after hot rolling at a cooling rate of 20° C./second to 700° C., then, after air-cooling for 5 seconds, cooling the sheet at a cooling rate of 30° C./second to 450° C., and then, applying a coiling equivalent treatment at 450° C. for one hour. The thus obtained hot-rolled steel sheet had a composite microstructure comprising ferrite as a main phase and martensite of an area ratio of 8%. After applying a pre-strain treatment to these hot-rolled steel sheets, a heat treatment was carried out to determine ΔTS.

As is known from FIG. 2, ΔTS increases along with an increase in the heat treatment temperature, and this increment is largely dependent upon the Cu content. When the Cu content is 1.3 wt. %, a high strain age hardening property can be obtained at a heat treatment temperature of 150° C. or more and a ΔTS of 80 MPa or more. With a Cu content of 0.3 wt. %, ΔTS is under 80 MPa, and a high strain age hardening property is unavailable at any heat treatment temperature.

From steel sheets having Cu contents of 0.3 wt. % and 1.3 wt. %, respectively, materials (hot-rolled steel sheets) having a yield ratio YR (=(yield strength YS/tensile strength TS)×100%) of within a range of from 50 to 90% were prepared by changing the cooling rate after hot rolling to various levels with a structure converted from ferrite+martensite into single ferrite phase. The hole expanding ratio (λ) was determined by carrying out a hole expanding test on these materials (hot-rolled steel sheets). In the hole expanding test, the hole expanding ratio λ was determined by forming punch holes in test pieces through punching with a punch having a diameter of 10 mm, and conducting hole expansion until occurrence of cracks running through the thickness, so that the burr is outside, by means of a conical punch having a vertical angle of 60°. The hole expanding ratio λ was determined by using a formula: $\lambda(\%)=\{(d-d_0)/d_0\}\times 100$, where $d_0$; initial hole diameter, and d: hole inside diameter upon occurrence of cracks.

Figure 3:
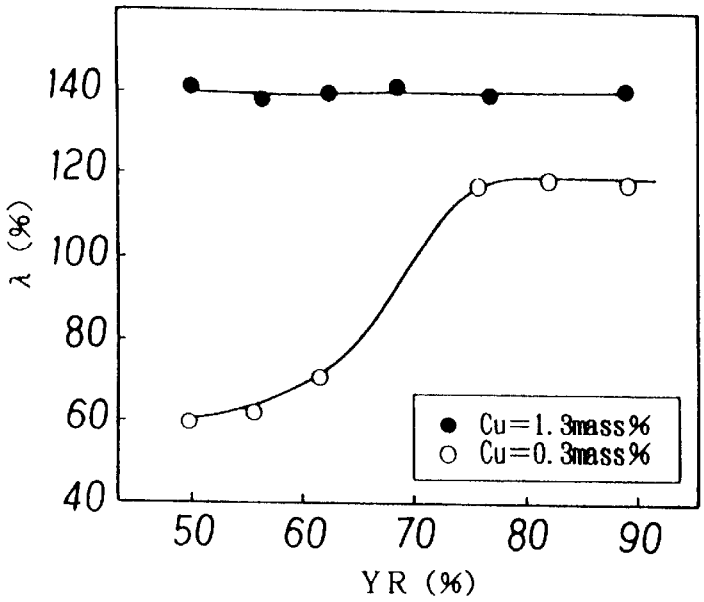
FIG. 3 is a graph illustrating the effect of the Cu content on the relationship between λ and YR of a hot-rolled steel sheet.

These result are arranged in terms of the relationship between the hole expanding ratio λ and yield ratio YR, and the derived effect of the Cu content on the relationship between the hole expanding ratio λ and yield ratio YR is illustrated in FIG. 3.

FIG. 3 suggests that a steel sheet having a Cu content of 0.3 wt. % has a composite ferrite (α)+martensite structure, and with a YR of under 70%, the decreasing YR results in a decrease in λ. A steel sheet having a Cu content of 1.3 wt. % has a composite ferrite (α)+martensite structure and keeps a high λ-value even with a decreasing YR. In a steel sheet having a Cu content of 0.3 wt. %, a low YR and a high λ cannot simultaneously be obtained.

This suggests the possibility to manufacture a hot-rolled steel sheet satisfying requirements of both a low yield ratio and a high hole expanding ratio by limiting the Cu content within an appropriate range and achieving a composite ferrite (α)+martensite structure.

In the hot-rolled steel sheet of the invention, very fine Cu precipitates in the steel sheet as a result of a pre-strain with an amount of strain of 2% or more as measured upon measuring the increment of deformation stress from before to after a usual heat treatment and the heat treatment carried out at a relatively low temperature as within a range of from 150 to 350° C. According to an investigation conducted by the present inventors, a high strain age hardening property leading to an increase in yield stress and a remarkable increase in tensile strength is considered to have been obtained through this precipitation of very fine Cu. Precipitation of very fine Cu by a heat treatment in a relatively low temperature region has never been observed in ultra-low carbon steel or low-carbon steel in reports so far released. A reason of precipitation of very fine Cu in a heat treatment at a relatively low temperature has not as yet been clarified to date, but it is conceivable that, during holding in the dual phase region of ferrite (α)+austenite (γ), Cu is largely distributed in the γ-phase, distributed Cu remaining even after cooling being converted into an super-saturated solid-solution state in martensite, and very finely precipitates through imparting of a prestrain of 5% or more and a low-temperature heat treatment.

The hole expanding ratio is increased in a steel sheet to which Cu is added and in which a composite ferrite+martensite structure is achieved. A detailed mechanism of this increase has not as yet been clarified. It is however considered attributable to the fact that addition of Cu reduces the difference in hardness between ferrite and martensite.

The hot-rolled steel sheet of the invention is a high-strength hot-rolled steel sheet having a tensile strength TS of 440 MPa or more and excellent in press-formability, of which tensile strength remarkably increases as a result of a heat treatment at a relatively low temperature after press forming, leading to an excellent strain age hardening property with a ΔTS of 80 MPa or more.

The structure of the hot-rolled steel sheet of the invention will now be described.

The hot-rolled steel sheet of the invention has a composite structure comprising a ferrite phase and a secondary phase containing martensite phase having an area ratio of 2% or more relative to the entire structure.

In order to obtain a steel sheet having a low yield strength YS and a high elongation El, and excellent in press-formability, in the invention, it is necessary to convert the structure of the hot-rolled steel sheet of the invention into a composite structure comprising a ferrite phase which is the main phase and a secondary phase containing martensite. Ferrite serving as the main phase should preferably have an area ratio of 50% or more. With ferrite of under 50%, it is difficult to keep a high elongation, resulting in a lower press-formability. When a satisfactory elongation is required, the area ratio of the ferrite phase should preferably be 80% or more. For the purpose of making full use of advantages of the composite structure, the ferrite phase should preferably be 98% or less.

In the invention, steel must contain martensite as the secondary phase in an area ratio of 2% or more relative to the entire structure. An area ratio of martensite of under 2% cannot simultaneously satisfy a low YS and a high El. The secondary phase may be a single martensite phase having an area ratio of 2% or more, or may be a mixture of a martensite phase of an area ratio of 2% or more and a secondary phase comprising a pearlite phase, a bainite phase, or a retained austenite phase.

The hot-rolled steel sheet having the above-mentioned structure thus becomes a steel sheet excellent in press-formability, with a low yield strength and a high elongation, and in strain age hardening property.

The reasons of limiting the chemical composition of the hot-rolled steel sheet of the invention will now be described. The weight percentage, wt. %, will hereafter be denoted simply as %.

C: 0.15% or less:

C is an element which improves strength of a steel sheet, and promotes formation of a composite structure of ferrite and martensite, and should preferably be contained in an amount of 0.01% or more for forming a composite structure in the invention. A C content of over 0.15% on the other hand causes an increase in partial ratio of carbides in steel, resulting in a decrease in elongation, and hence a decrease in press-formability. A more important problem is that a C content of over 0.15% leads to a serious decrease in spot weldability and arc weldability. For these reasons, in the invention, the C content is limited to 0.15% or less. From the point of view of formability, the C content should more preferably be 0.10% or less.

Si: 2.0% or less:

Si is a useful strengthening element which can improve strength of a steel sheet without causing a marked decrease in elongation of the steel sheet, and is effective for accelerating ferrite transformation and promoting martensite formation through C concentration into non-transformed austenite. A Si content of over 2.0% however leads to deterioration of press-formability and deteriorates the surface quality. The Si content is therefore limited to 2.0% or less. With a view to forming martensite, Si should preferably be contained in an amount of 0.1% or more.

Mn: 3.0% or less:

Mn has a function of strengthening steel, and of accelerating formation of a composite ferrite+martensite structure. Mn is an element effective for preventing hot cracking caused by S, and should therefore be contained in an amount dependent upon S content. These effects are particularly remarkable at a Mn content of 0.5% or more. On the other hand, a Mn content of over 3.0% results in deterioration of press-formability and weldabillity. The Mn content is therefore limited to 3.0% or less, and more preferably, to 1.0% or more.

P: 0.10% or less:

P has a function of strengthening steel, and can be contained in an amount necessary for a desired strength. An excessive P content however causes deterioration of press-formability. The P content is therefore limited to 0.10% or less. When a further higher press-formability is required, the P content should preferably be 0.08% or less.

S: 0.02% or less:

S is an element which is present as inclusions in steel and causes deterioration of elongation, formability, and particularly stretch flanging formability of a steel sheet. It should therefore be the lowest possible. A S content reduced to 0.02% or less does not exert much adverse effect. In the invention, therefore, the S content is limited to 0.02% or less. When an excellent stretch flanging formability is required, the S content should preferably be 0.010% or less.

Al: 0.10% or less:

Al is an element which is added as a deoxidizing element of steel, and is useful for improving cleanliness of steel. However, an Al content of over 0.10% cannot give a further deoxidizing effect, but causes in contrast deterioration of press-formability. The Al content is therefore limited to 0.10% or less, and preferably, 0.01% or more. The invention does not exclude a steelmaking process based on a deoxidation by means of a deoxidizer other than Al. For example, Ti deoxidation or Si deoxidation may be used, and steel sheets produced by such deoxidation methods are also included in the scope of the invention.

N: 0.02% or less:

N is an element which increases strength of a steel sheet through solid-solution strengthing or strain age hardening. A N content of over 0.02% however causes an increase in the content of nitrides in the steel sheet, which in turn causes a serious deterioration of elongation, and furthermore, of press-formability. The N content is therefore limited to 0.02% or less. When further improvement of press-formability is required, the N content should suitably be 0.01% or less.

Cu: from 0.5 to 3.0%:

Cu is an element which remarkably increases strain age hardening of a steel sheet (increase in strength after pre-strain—heat treatment), and is one of the most important elements in the invention. With a Cu content of under 0.5%, an increase in tensile strength of over ΔTS: 80 MPa even by using different pre-strain—heat treatment conditions cannot be obtained. In the invention, therefore, Cu should be contained in an amount of 0.5% or more. With a Cu content of over 3.0%, on the other hand, the effect is saturated so that an effect corresponding to the content cannot be expected, leading to unfavorable economic effects. Deterioration of press-formability results, and the surface quality of the steel sheet degrades. The Cu content is therefore limited within a range of from 0.5 to 3.0%. In order to simultaneously achieve a higher ΔTS and an excellent press-formability, the Cu content should preferably be within a range of from 1.0 to 2.5%.

In the invention, in addition to the chemical composition containing Cu as described above, it is desirable to contain, in weight percentage, one or more of the following groups A to C:

group A: Ni: 2.0% or less;

group B: one or two of Cr and Mo: 2.0% or less in total; and group C: one or more of Nb, Ti and V: 0.2% or less in total.

Group A: Ni: 2.0% or less:

Group A: Ni is an element effective for preventing surface defects produced on the steel sheet surface upon adding Cu, and can be contained as required. If contained, the Ni content, depending upon the Cu content, should preferably be about a half the Cu content. An Ni content of over 2.0% cannot give a corresponding effect because of saturation of the effect, leading to economic disadvantages, and causes deterioration of press-formability. The Ni content should preferably be limited to 2.0% or less.

Group B: one or two of Cr and Mo: 2.0% or less in total:

Group B: As in Mn, both Cr and Mo have a function of promoting formation of a composite ferrite+martensite structure, and can be contained as required. If one or two of Cr and Mo are contained in an amount of over 2.0% in total, there occurs a decrease in press-formability. It is therefore desirable to limit the total content of one or two of Cr and Mo forming group B to 2.0% or less.

Group C: one or more of Nb, Ti and V: 0.2% or less in total:

Group C: Nb, Ti and V are carbide-forming elements which effectively act to increase strength through fine dispersion of carbides, and can be selected and contained as required. However, if the total content of one or more of Nb, Ti and V is over 0.2%, there occurs deterioration of press-formability. The total content of Nb, Ti and/or V should therefore preferably be limited to 0.2% or less.

In the invention, in place of the aforementioned Cu, or further one or more of the above-mentioned groups A to C, one or more selected from the group consisting of from 0.05 to 2.0% Mo, from 0.05 to 2.0% Cr, and from 0.05 to 2.0% W may be contained in an amount of 2.0% or less in total, or further one or more selected from the group consisting of Nb, Ti and V in an amount of 2.0% or less in total.

One or more selected from the group consisting of from 0.05 to 2.0% Mo, from 0.05 to 2.0% Cr and from 0.05 to 2.0% W, in an amount of 2.0% in total:

Mo, Cr and W are elements which cause a remarkable increase in strain age hardening of a steel sheet, are the most important elements in the invention, and can be selected and contained. Containing one or more of Mo, Cr and W, and achievement of a composite ferrite+martensite structure cause strain-induced fine precipitation of fine carbides during pre-strain—heat treatment, thus making it possible to obtain a tensile strength as represented by a ΔTS of 80 MPa or more. With a content of each of these elements of under 0.05%, changing of pre-strain—heat treatment conditions or the steel sheet structure does not give an increase in tensile strength represented by a ΔTS of 80 MPa or more. On the other hand, even if the content of each of these elements is over 2.0%, an effect corresponding to the content cannot be expected as a result of saturation of the effect, leading to economic disadvantages, and this results in deterioration of press-formability. The contents of Mo, Cr and W are therefore limited within a range of from 0.05 to 2.0% for Mo, from 0.05 to 2.0% for Cr, and from 0.05 to 2.0% for W. From the point of view of press-formability, the total content of Mo, Cr and/or W is limited to 2.0% or less.

One or more of Nb, Ti and V: 2.0% or less in total:

Nb, Ti and V are carbide-forming elements, and can be selected and contained as required. Containing one or more of Nb, Ti and V, and achievement of a composite ferrite+martensite structure cause strain-induced fine precipitation of fine carbides during pre-strain—heat treatment, thus making it possible to obtain a tensile strength as represented by a ΔTS of 80 MPa or more. However, a total content of one or more of Nb, Ti and V of over 2.0% causes deterioration of press-formability. The total content of Nb, Ti and/or V should therefore preferably be limited to 2.0% or less.

Apart from the above-mentioned elements, one or two of 0.1% or less Cu and 0.1% or less REM may be contained. Ca and REM are elements contributing to improvement of elongation through shape control of inclusions. If the Ca content is over 0.1% and the REM content is over 0.1%, however, there would be a decrease in cleanliness, and a decrease in elongation.

From the point of view of forming martensite, one or two of up to 0.1% B and up to 0.1% Zr may be contained.

The balance except for the above-mentioned constituents comprises Fe and incidental impurities. Allowable incidental impurities include 0.01% or less Sb, 0.01% or less Pb, 0.1% or less Sn, 0.01% or less Zn, and 0.1% or less Co.

The hot-rolled steel sheet having the aforementioned chemical composition and structure has a low yield strength and a high elongation, excellent in press-formability and in strain age hardening property.

A manufacturing method of the hot-rolled steel sheet of the present invention will now be described.

The hot-rolled steel sheet of the invention is made from a steel slab, as a material, having a chemical composition within the ranges described above, and by hot-rolling such a material into a prescribed thickness.

While the steel slab used should preferably be manufactured by the continuous casting process to prevent macro-segregation of the constituents, or may be manufactured by the ingot casting process or the thin continuous casting process. An energy-saving process such as direct-hot-charge rolling or direct rolling is applicable with no problem, which comprises the steps of manufacturing a steel slab, then once cooling the slab to room temperature, then reheating as in the conventional art, and charging the same into a reheating furnace as a hot slab without cooling, or immediately rolling the slab after slight holding.

It is not necessary to impose a particular restriction on the reheating temperature of the material (steel slab), but it should preferably be 900° C. or more.

Slab reheating temperature: 900° C. or more:

The slab reheating temperature SRT should preferably be the lowest possible with a view to preventing surface defects caused by Cu when the chemical composition contains Cu. However, with a reheating temperature of under 900° C., there is an increase in the rolling load, thus increasing the risk of occurrence of a trouble during hot rolling. Considering the increase in scale loss caused along with the increase in weight loss of oxidation, the slab reheating temperature should preferably be 1,300° C. or below.

From the point of view of reducing the slab reheating temperature and preventing occurrence of a trouble during hot rolling, use of a so-called sheet bar heater based on heating a sheet bar is of course an effective method.

The reheated slab is then hot-rolled. Hot rolling should preferably be performed at a finish rolling end temperature FDT of the $Ar_3$ transformation point or more.

Finish rolling end temperature: $Ar_3$ transformation point or more:

By adopting a finish rolling end temperature FDT of the $Ar_3$ transformation point or more, it is possible to obtain a uniform structure of the hot-rolled mother sheet, and a composite ferrite+martensite structure through cooling after hot rolling. This ensures maintenance of an excellent press-formability. On the other hand, a finish rolling end temperature of under the $Ar_3$ transformation point leads to a non-uniform structure of the hot-rolled mother sheet, and the remaining deformation structure causes deterioration of press-formability. Furthermore, a finish rolling end temperature of under the $Ar_3$ transformation point results in a higher rolling load during hot rolling, and a higher risk of occurrence of troubles during hot rolling. The FDT of hot rolling should therefore preferably be $Ar_3$ transformation point or more.

After the completion of finish rolling, cooling should preferably be carried out at a cooling rate of 5° C./second or more to a temperature region from $Ar_3$ transformation point to $Ar_1$ transformation point.

By cooling the sheet after hot rolling as described above, it is possible to accelerate ferrite transformation through the subsequent cooling step. With a cooling rate of under 5° C./second, ferrite transformation is not promoted in subsequent cooling, thus leading to deterioration of press-formability.

Then, it is desirable to air-cool or slowly cool the sheet for a period from 1 to 20 seconds within a temperature region of from ($Ar_3$ transformation point) to ($Ar_1$ transformation point). By conducting air cooling or slow cooling within the temperature region of from ($Ar_3$ transformation point) to ($Ar_1$ transformation point) transformation from austenite to ferrite is promoted, and furthermore, C is concentrated in non-transformed austenite, which is transformed into martensite through subsequent cooling, thus forming a composite ferrite+martensite structure. An air cooling or slow cooling of under 1 second within the temperature region of from ($Ar_3$ transformation point) to ($Ar_1$ transformation point) leads to only a slight amount of transformation from austenite into ferrite, resulting in a slight amount of concentration of C into non-transformed austenite, and hence in only a small amount of formation of martensite. On the other hand, a cooling time of over 20 seconds causes transformation of austenite to pearlite, thus making it impossible to obtain a composite ferrite+martensite structure.

After air cooling or slow cooling, the rolled sheet is cooled again at a cooling rate of 5° C./second or more, and coiled at a coiling temperature of 550° C. or below.

By cooling the sheet at a cooling rate of 5° C./second or more, non-transformed austenite is transformed into martensite. This converts the structure into a composite ferrite+martensite structure. When the cooling rate is under 5° C./second or the coiling temperature CT is higher than 550° C., non-transformed austenite is transformed into pearlite or bainite, and martensite is not formed, thus leading to a decrease in press-formability. The cooling rate should more preferably be 10° C./second or more, or still more preferably, 100° C./second or less from the point of view of hot-rolled sheet shape. The coiling temperature CT should be under 500° C., and preferably, 350° C. or more from the point of view of the hot-rolled sheet shape. A coiling temperature of under 350° C. causes serious disorder of the steel sheet shape, and an increase in the risk of occurrence of inconveniences during practical use.

In hot rolling in the present invention, all or part of finish rolling may be lubrication rolling to reduce the rolling load during hot rolling. Application of lubrication rolling is effective with a view to achieving a uniform steel sheet shape and a uniform material quality. The frictional coefficient during lubrication rolling should preferably be within a range of from 0.25 to 0.10. It is desirable to adopt a continuous rolling process comprising connecting sheet bars in succession and rolling the same continuously. Application of the continuous rolling process is desirable also from the point of view of operational stability of hot rolling.

After the completion of hot rolling, temper rolling of 10% or less may be applied for adjustment such as shape correction or surface roughness control.

The hot-rolled steel sheet of the invention is applicable not only for working but also as an mother sheet for surface treatment. Applicable surface treatments include galvanizing (including alloying), tin-plating and enameling.

After annealing or a surface treatment such as galvanizing, the hot-rolled steel sheet of the invention may be subjected to a special treatment to improve chemical conversion treatment property, weldability, press-formability and corrosion resistance.

The cold-rolled steel sheet will now be described.

First, the result of a fundamental experiment carried out by the present inventors on the cold-rolled steel sheet will be presented.

A sheet bar having a chemical composition comprising, in weight percentage, 0.04% C, 0.02% Si, 1.7% Mn, 0.01% P, 0.005% S, 0.04% Al, 0.002% N and 0.3 or 1.3% Cu was heated to 1,150° C., soaked and subjected to three-pass rolling into a thickness of 4.0 mm so that the finish rolling end temperature was 900° C. After the completion of finish rolling and coiling, a temperature holding equivalent treatment of 600° C.×1 h was applied. Thereafter, the sheet was cold-rolled at a reduction of 70% into a cold-rolled steel sheet having a thickness of 1.2 mm. Then, recrystallization annealing was applied to cold-rolled sheets under various conditions.

Tensile properties were investigated by conducting a tensile test on the resultant cold-rolled steel sheets. Strain age hardening properties of these cold-rolled steel sheets were investigated.

Tensile properties were determined by first sampling test pieces from these cold-rolled steel sheets, applying a pre-strain treatment with a tensile prestrain of 5% to these test pieces, then performing a heat treatment of 50 to 350° C.×20 minutes, and then conducting a tensile test. The strain age hardening properties were evaluated in terms of the tensile strength increment ΔTS from before to after the heat treatment, as described in the section of hot-rolled steel sheet.

Figure 4:
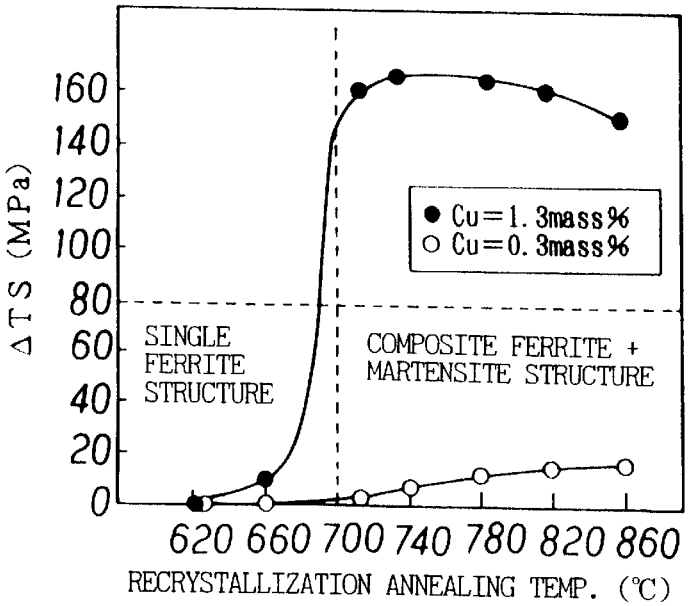
FIG. 4 is a graph illustrating the effect of the Cu content on the relationship between ΔTS and the recrystallization temperature after pre-strain—heat treatment of a cold-rolled steel sheet.

FIG. 4 illustrates the effect of the Cu content on the relationship between ΔTS of the cold-rolled steel sheet and the recrystallization annealing temperature. The value of ΔTS was determined by applying a pre-strain treatment with a tensile prestrain of 5% to test pieces sampled from the resultant cold-rolled steel sheets, conducting a heat treatment of 250° C.×20 minutes, and carrying out a tensile test.

FIG. 4 suggests that a high strain age hardening property as represented by a ΔTS of 80 MPa or more is available, in the case of a Cu content of 1.3 wt. %, by using a recrystallization annealing temperature of 700° C. or more to convert the steel sheet structure into a composite ferrite+martensite structure. On the other hand, in the case of a Cu content of 0.3 wt. %, a high strain age hardening property is unavailable because ΔTS is under 80 MPa at any recrystallization annealing temperature. FIG. 4 suggests the possibility to manufacture a cold-rolled steel sheet having a high strain age hardening property by optimizing the Cu content and achieving a composite ferrite+martensite structure.

Figure 5:
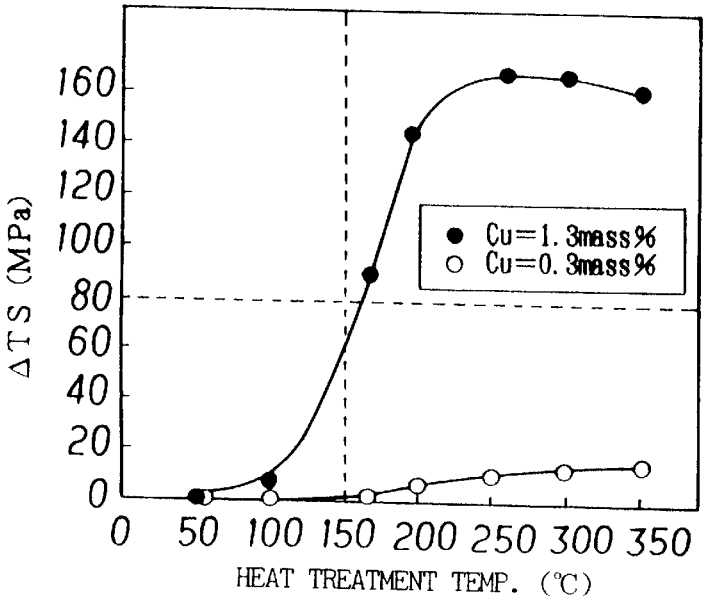
FIG. 5 is a graph illustrating the effect of the Cu content on the relationship between ΔTS and the heat treatment temperature after pre-strain—heat treatment of a cold-rolled steel sheet.

FIG. 5 illustrates the effect of the Cu content on the relationship between ΔTS of the cold-rolled steel sheet and the heat treatment temperature after a pre-strain treatment. The steel sheet used was annealed at 800° C. which was the dual phase region of ferrite (α)+austenite (γ) for a holding time of 40 seconds after cold rolling, and cooled from a holding temperature (800° C.) at a cooling rate of 30° C./second to room temperature. The steel sheets had a composite ferrite+martensite (secondary phase) microstructure, with a martensite structural partial ratio represented by an area ratio of 8%.

It is known from FIG. 5 that ΔTS increases according as the heat treatment temperature increases, and the increment thereof largely depends upon the Cu content. With a Cu content of 1.3 wt. %, a high strain age hardening property as represented by a ΔTS of 80 MPa or more is available at a heat treatment temperature of 150° C. or more. For a Cu content of 0.3 wt. %, ΔTS is under 80 MPa at any heat treatment temperature, and a high strain age hardening property cannot be obtained.

For steel sheets as cold-rolled having a Cu content of 0.3 or 1.3 wt. %, materials (steel sheets) were prepared under various recrystallization annealing conditions, with a composite ferrite+martensite structure or a single ferrite structure, of which the yield ratio YR (=(yield strength YS/tensile strength TS)×100%) ranged from 50 to 90%. For these materials (steel sheets) a hole expanding test was carried out to determine the hole expanding ratio (λ). In the hole expanding test, the hole expanding ratio λ was determined by forming a punch hole in a test piece by punching with a punch having a diameter of 10 mm, expanding the hole until production of cracks running through the thickness so that burs were produced on the outside by means of a conical punch having a vertical angle of 60°. The hole-expanding ratio λ was calculated by a formula: $\lambda(\%)=\{(d-d_0)/d_0\}\times 100$, where $d_0$: initial hole diameter, and d: inner hole diameter upon occurrence of cracks.

Figure 6:
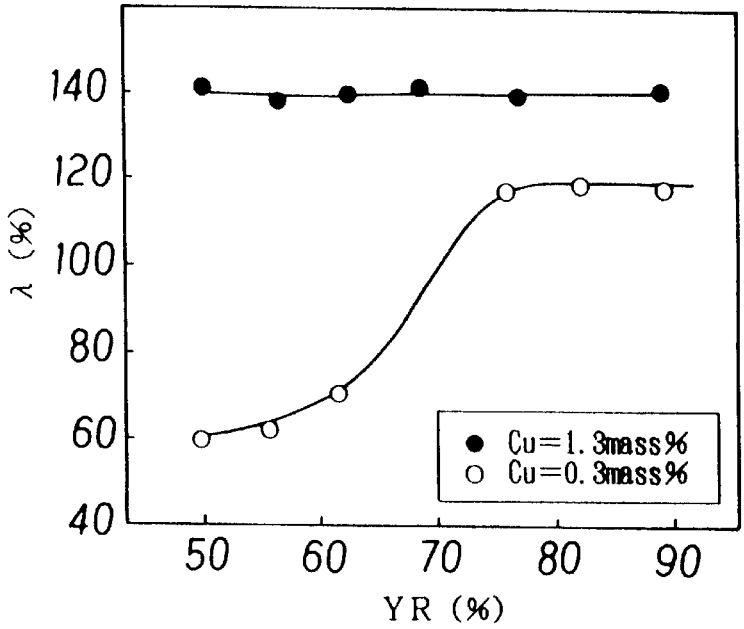
FIG. 6 is a graph illustrating the effect of the Cu content on the relationship between λ and YR of a cold-rolled steel sheet.

These results, arranged in terms of the relationship between the hole expanding ratio λ and the yield ratio YR, to serve as the effect of the Cu content on the relationship between the hole expanding ratio λ and the yield ratio YR of the cold-rolled steel sheet are illustrated in FIG. 6.

According to FIG. 6, in a steel sheet having a Cu content of 0.3 wt. %, achievement of a composite ferrite+martensite structure and a YR of under 70% lead to a decrease in λ along with a decrease in YR. In a steel sheet having a Cu content of 1.3 wt. %, a high λ-value is maintained even when a composite ferrite+martensite structure is achieved and a low YR is kept. On the other hand, a low YR and a high λ cannot simultaneously be obtained in the steel sheet having a Cu content of 0.3 wt. %.

It is known from FIG. 6 that a cold-rolled steel sheet satisfying both a low yield ratio and a high hole expanding ratio can be manufactured by using a Cu content within an appropriate range and achieving a composite ferrite+martensite structure.

In the cold-rolled steel sheet of the invention, very fine Cu precipitates in the steel sheet as a result of a pre-strain with an amount of strain larger than 2% which is the amount of prestrain upon measuring the deformation stress increment from before to after a usual heat treatment, and a heat treatment within a relatively low temperature region as from 150 to 350° C. According to a study carried out by the present inventors, a high strain age hardening property bringing about an increase in yield stress and a remarkable increase in tensile strength is considered to have been obtained from this precipitation of very fine Cu. Such precipitation of very fine Cu by a heat treatment in a low-temperature region has never been observed in ultra-low carbon steel or low-carbon steel in reports so far released. The reason of precipitation of very fine Cu by a heat treatment in a low-temperature region has not as yet been clarified to date. A conceivable reason is that, during annealing in the dual phase region of α+γ phase, much Cu is distributed in the γ-phase, and the distributed Cu is kept even after cooling in an super-saturated solid-solution state (of Cu) in martensite, which precipitates in a very fine form as a result of imparting of a prestrain of at least 5% and a low-temperature heat treatment.

A detailed mechanism which gives a high hole expanding ratio of the steel sheet added with Cu and having a composite ferrite+martensite structure is not clearly known at present, but it is considered to be due to the fact that addition of Cu reduced the difference in hardness between ferrite and martensite.

The cold-rolled steel sheet of the invention is a high-strength cold-rolled steel sheet having a tensile strength TS of 440 MPa or more and excellent in press-formability, of which tensile strength is remarkably increased by a heat treatment at a relatively low temperature after press forming, and having an excellent strain age hardening property typically represented by a ΔTS 80 MPa or more.

The structure of the cold-rolled steel sheet of the invention will now be described.

The cold-rolled steel sheet of the invention has a composite structure comprising a ferrite phase and a secondary phase containing a martensite phase of an area ratio of 2% or more.

For the purpose of achieving a cold-rolled steel sheet having a low yield strength YS and a high elongation El and excellent in press-formability, in the invention, it is necessary to achieve a composite structure comprising a ferrite phase which is the main phase and a secondary phase containing martensite. Ferrite, the main phase, should preferably have an area ratio of 50% or more. If ferrite is under 50% in area ratio, it is difficult to keep a high elongation, leading to a lower press-formability. When a better elongation is required, the ferrite phase should preferably have an area ratio of 80% or more. For making use of the composite structure, the ferrite phase should preferably have an area ratio of 98% or less.

In the present invention, martensite as the secondary phase must be contained in an area ratio of 2% or more. When the area ratio of martensite is under 2%, a low YS and a high El cannot simultaneously be satisfied. The secondary phase may be a single martensite phase having an area ratio of 2% or more, or a mixture of a martensite phase having an area ratio of 2% or more with any of the other pearlite phase, bainite phase and retained austenite phase. There is imposed no particular restriction in this respect.

The cold-rolled steel sheet having the structure as described above has a low yield strength and a high elongation, is excellent in press-formability, and excellent in strain age hardening property.

The reasons of limiting the chemical composition of the cold-rolled steel sheet of the invention to the aforementioned ranges will now be described. The weight percentage will simply be denoted hereafter as %.

C: 0.15% or less:

C is an element which improves strength of a steel sheet, and promotes formation of a composite structure of ferrite and martensite, and should preferably be contained in an amount of 0.01% or more for forming a composite structure in the invention. A C content of over 0.15% on the other hand causes an increase in partial ratio of carbides in steel, resulting in a decrease in elongation, and hence a decrease in press-formability. A more important problem is that a C content of over 0.15% leads to a serious decrease in spot weldability and arc weldability. For these reasons, in the invention, the C content is limited to 0.15% or less. From the point of view of formability, the C content should more preferably be 0.10% or less.

Si: 2.0% or less:

Si is a useful strengthening element which can improve strength of a steel sheet without causing a marked decrease in elongation of the steel sheet. A Si content of over 2.0% however leads to deterioration of press-formability and degrades the surface quality. The Si content is therefore limited to 2.0% or less, and preferably, to 0.1% or more.

Mn: 3.0% or less:

Mn has a function of strengthening steel, reducing the critical cooling rate for obtaining a composite ferrite+martensite structure, and accelerating formation of the composite ferrite+martensite structure. The Mn content should preferably correspond to the cooling rate after recrystallization annealing. Mn is an element effective for preventing hot cracking caused by S, and should therefore be contained in an amount dependent upon the S content. These effects are particularly remarkable at a Mn content of 0.5% or more. On the other hand, a Mn content of over 3.0% results in deterioration of press-formability and weldability. The Mn content is therefore limited to 3.0% or less, and more preferably, to 1.0% or more.

P: 0.10% or less:

P has a function of strengthening steel, and can be contained in an amount necessary for a desired strength. An excessive P content however causes deterioration of press-formability. The P content is therefore limited to 0.10% or less. When a further higher press-formability is required, the P content should preferably be 0.08% or less.

S: 0.02% or less:

S is an element which is present as inclusions in steel and causes deterioration of elongation, formability, and particularly stretch flanging formability of a steel sheet. It should therefore be the lowest possible. A S content reduced to up to 0.02% does not exert much adverse effect. In the invention, therefore, the S content is limited to 0.02% or less. When an excellent stretch flanging formability is required, the S content should preferably be 0.010% or less.

Al: 0.10% or less:

Al is an element which is added as a deoxidizing element of steel, and is useful for improving cleanliness of steel. However, an Al content of over 0.10% cannot give a further deoxidizing effect, but causes in contrast deterioration of press-formability. The Al content is therefore limited to 0.10% or less. The invention does not exclude a steelmaking process based on a deoxidation by means of a deoxidizer other than Al. For example, Ti deoxidation or Si deoxidation may be used, and steel sheets produced by such deoxidation methods are also included in the scope of the invention. In this case, addition of Ca or REM to molten steel does not impair the features of the steel sheet of the invention at all. It is needless to mention that steel sheets containing Ca or REM are also included within the scope of the invention.

N: 0.02% or less:

N is an element which increases strength of a steel sheet through solid-solution strengthing or strain age hardening. A N content of over 0.02% however causes an increase in the content of nitrides in the steel sheet, which in turn causes a serious deterioration of elongation, and furthermore, of press-formability. The N content is therefore limited to 0.02% or less. When further improvement of press-formability is required, the N content should suitably be 0.01% or less.

Cu: from 0.5 to 3.0%:

Cu is an element which remarkably increase strain age hardening of a steel sheet (increase in strength after pre-strain—heat treatment), and is one of the most important elements in the invention. With a Cu content of under 0.5%, an increase in tensile strength of over ΔTS: 80 MPa cannot be obtained even by using different pre-strain—heat treatment conditions. In the invention, therefore, Cu should be contained in an amount of 0.5% or more. With a Cu content of over 3.0%, on the other hand, the effect is saturated so that an effect corresponding to the content cannot be expected, leading to unfavorable economic effects. Deterioration of press-formability results, and the surface quality of the steel sheet is degraded. The Cu content is therefore limited within a range of from 0.5 to 3.0%. In order to simultaneously achieve a higher ΔTS and an excellent press-formability, the Cu content should preferably be within a range of from 1.0 to 2.5%.

In the invention, in addition to the chemical composition containing Cu as described above, it is desirable to contain, in weight percentage, one or more of the following groups A to C:

group A: Ni: 2.0% or less;

group B: one or two of Cr and Mo: 2.0% or less in total; and group C: one or more of Nb, Ti and V: 0.2% or less in total.

Group A: Ni: 2.0% or less:

Group A: Ni is an element effective for preventing surface defects produced on the steel sheet surface upon adding Cu, and can be contained as required. If contained, the Ni content, depending upon the Cu content, should preferably be about a half the Cu content. A Ni content of over 2.0% cannot give a corresponding effect because of saturation of the effect, leading to economic disadvantages, and causes deterioration of press-formability. The Ni content should preferably be limited to 2.0% or less.

Group B: one or two of Cr and Mo: 2.0% or less in total:

Group B: As in Mn, both Cr and Mo have a function of promoting formation of a composite ferrite+martensite structure, and can be contained as required. If one or two of Cr and Mo are contained in an amount of over 2.0% in total, there occurs a decrease in press-formability. It is therefore desirable to limit the total content of one or two of Cr and Mo forming group B to 2.0% or less.

Group C: one or more of Nb, Ti and V: 0.2% or less in total:

Group C: Nb, Ti and V are carbide-forming elements which effectively act to increase strength through fine dispersion of carbides, and can be selected and contained as required. However, if the total content of one or more of Nb, Ti and V is over 0.2%, there occurs deterioration of press-formability. The total content of Nb, Ti and/or V should therefore preferably be limited to 0.2% or less.

In the invention, in place of the aforementioned Cu, one or more selected from the group consisting of from 0.05 to 2.0% Mo, from 0.05 to 2.0% Cr, and from 0.05 to 2.0% W may be contained in an amount of 2.0% or less in total, or further one or more selected from the group consisting of Nb, Ti and V in an amount of 2.0% or less in total.

One or more selected from the group consisting of from 0.05 to 2.0% Mo, from 0.05 to 2.0% Cr and from 0.05 to 2.0% W, in an amount of 2.0% or less in total:

Mo, Cr and W are elements which cause a remarkable increase in strain age hardening of a steel sheet, are the most important elements in the invention, and can be selected and contained as required. Containing one or more of Mo, Cr and W and achievement of a composite ferrite+martensite structure cause strain-induced fine precipitation of fine carbides during pre-strain—heat treatment, thus making it possible to obtain a tensile strength as represented by a ΔTS of 80 MPa or more. With a content of each of these elements of under 0.05%, changing of pre-strain—heat treatment conditions or the steel sheet structure does not give an increase in tensile strength as represented by a ΔTS of 80 MPa or more. On the other hand, even if the content of each of these elements is over 2.0%, an effect corresponding to the content cannot be expected as a result of saturation of the effect, leading to economic disadvantages, and this results in deterioration of press-formability. The contents of Mo, Cr and W are therefore limited within a range of from 0.05 to 2.0% for Mo, from 0.05 to 2.0% for Cr, and from 0.05 to 2.0% for W. From the point of view of press-formability, the total content of Mo, Cr and W is limited to 2.0% or less.

One or more of Nb, Ti and V: 2.0% or less in total:

Nb, Ti and V are carbide-forming elements, and, when containing one or more of Mo, Cr and W, can be selected and contained as required. Containing one or more of Nb, Ti and V, and achievement of a composite ferrite+martensite structure cause strain-induced fine precipitation of fine carbides during pre-strain—heat treatment, thus making it possible to obtain a tensile strength as represented by a ΔTS of 80 MPa or more. However, a total content of one or more of Nb, Ti and V of over 2.0% causes deterioration of press-formability. The total content of Nb, Ti and/or V should therefore preferably be limited to 2.0% or less.

Apart from the above-mentioned elements, one or two of 0.1% or less Ca and 0.1% or less REM may be contained. Ca and REM are elements contributing to improvement of elongation through shape control of inclusions. If the Ca content is over 0.1% and the REM content is over 0.1%, however, there would be a decrease in cleanliness, and a decrease in elongation.

From the point of view of forming martensite, one or two of 0.1% or less B and 0.1% or less Zr may be contained.

The balance except for the above-mentioned elements comprises Fe and incidental impurities. Allowable incidental impurities include 0.01% or less Sb, 0.01% or less Pb, 0.1% or less Sn, 0.01% or less Zn, and 0.1% or less Co.

The manufacturing method of the cold-rolled steel sheet of the invention will now be described.

The cold-rolled steel sheet of the invention is manufactured by using, as a material, a steel slab having the chemical composition within the aforementioned ranges, and sequentially carrying out a hot rolling step of hot-rolling the steel slab into a hot-rolled steel sheet, a cold rolling step of cold-rolling the hot-rolled steel sheet into a cold-rolled steel sheet, and a recrystallization annealing step of applying recrystallization annealing to the cold-rolled steel sheet into a cold-rolled annealed steel sheet.

While the steel slab used should preferably be manufactured by the continuous casting process to prevent macro-segregation of the elements, it may be manufactured by the ingot casting process or the thin-slab continuous casting process. An energy-saving process such as direct-hot-charge rolling or direct rolling is applicable with no problem, which comprises the steps of manufacturing a steel slab, then once cooling the slab to room temperature, then reheating the slab as in the conventional art, and charging the same into a reheating furnace as a hot slab without cooling, or immediately rolling the slab after slight holding.

The above-mentioned material (steel slab) is reheated, and subjected to the hot rolling step of applying hot rolling to make a hot-rolled steel sheet. Usual known conditions for the hot rolling step pose no problem only so far as these conditions permit manufacture of a hot-rolled steel sheet having a desired thickness. Preferable hot rolling conditions are as follows:

Slab reheating temperature: 900° C. or more.

The slab reheating temperature SRT should preferably be the lowest possible with a view to preventing surface defects caused by Cu when the chemical composition contains Cu. However, with a reheating temperature of under 900° C., there is an increase in the rolling load, thus increasing the risk of occurrence of a trouble during hot rolling. Considering the increase in scale loss caused along with the increase in weight loss of oxidation, the slab reheating temperature should preferably be 1,300° C. or less.

From the point of view of reducing the slab reheating temperature and preventing occurrence of a trouble during hot rolling, use of a so-called sheet bar heater based on heating a sheet bar is of course an effective method.

Finish rolling end temperature: 700° C. or more:

By adopting a finish rolling end temperature FDT of 700° C. or more, it is possible to obtain a uniform hot-rolled mother sheet structure which can give an excellent formability after cold rolling and recrystallization annealing. On the other hand, a finish rolling end temperature of under 700° C. results in a non-uniform hot-rolled mother sheet structure, and a higher rolling load during hot rolling, leading to an increased risk of occurrence of troubles during hot rolling. For these reasons, the FDT in the hot rolling step should preferably be 700° C. or more.

Coiling temperature: 800° C. or below:

The coiling temperature CT should preferably be 800° C. or below, and more preferably, 200° C. or more. A coiling temperature of over 800° C. tends to cause a decrease in yield as a result of increase of scale causing a scale loss. With a coiling temperature of under 200° C., the steel sheet shape is in marked disorder, and there is an increasing risk of occurrence of inconveniences in practical use.

In the hot rolling step in the invention, as described above, it is desirable to reheat the slab to a temperature of 900° C. or more, hot-roll the reheated slab at a finish rolling end temperature of 700° C. or more, and coil the hot-rolled steel sheet at a coiling temperature of 800° C. or below, and preferably 200° C. or more.

In hot rolling in the present invention, all or part of finish rolling may be lubrication rolling to reduce the rolling load during hot rolling. Application of lubrication rolling is effective with a view to achieving a uniform steel sheet shape and a uniform material quality. The frictional coefficient during lubrication rolling should preferably be within a range of from 0.25 to 0.10. It is desirable to adopt a continuous rolling process comprising connecting sheet bars in succession and rolling the same continuously. Application of the continuous rolling process is desirable also from the point of view of operational stability of hot rolling.

Then, the cold rolling step is conducted on the hot-rolled steel sheet. In the cold rolling step, the hot-rolled steel sheet is cold-rolled into a cold-rolled steel sheet. The cold rolling conditions suffice to permit production of a cold-rolled steel sheet having a desired dimensions, and no particular restriction is imposed. The cold rolling reduction should preferably be 40% or more. With a reduction of under 40%, it becomes difficult for recrystallization to take place uniformly during the recrystallization annealing that follows.

Then, the cold-rolled steel sheet is subjected to a recrystallization annealing step to convert the sheet into a cold-rolled annealed steel sheet. Recrystallization annealing should preferably be carried out on a continuous annealing line, or on a continuous hot-dip galvanizing line. The annealing temperature for recrystallization annealing should preferably be within an ($\alpha+\gamma$) dual phase region in a temperature range of from the $Ac_1$ transformation point to the $Ac_3$ transformation point. An annealing temperature of under the $Ac_1$ transformation point leads to a single ferrite phase. At a high temperature of over $Ac_3$ transformation point results in coarsening of crystal grains, a single austenite phase, and a serious deterioration of press-formability. By annealing the sheet in the ($\alpha+\gamma$) dual phase region, it is possible to obtain a composite ferrite+martensite structure and a high ΔTS.

The cooling rate for cooling the sheet during recrystallization annealing should preferably be 1° C./second or more with a view to forming martensite.

After the completion of hot rolling, temper rolling of 10% or less may be applied for adjustment such as shape correction or surface roughness control.

The cold-rolled steel sheet of the invention is applicable not only for working but also as an mother sheet for surface treatment. Applicable surface treatments include galvanizing (including alloying), tin-plating and enameling.

After annealing or a surface treatment such as galvanizing, the cold-rolled steel sheet of the invention may be subjected to a special treatment to improve chemical conversion treatment property, weldability, press-formability and corrosion resistance.

The hot-dip galvanized steel sheet will now be described.

First, the result of a fundamental experiment carried out by the present inventors on the hot-dip galvanized steel sheet will be presented.

A sheet bar having a chemical composition comprising, in weight percentage, 0.04% C, 0.02% Si, 1.7% Mn, 0.01% P, 0.004% S, 0.04% Al, 0.002% N and 0.3 or 1.3% Cu was heated to 1,150° C., soaked and subjected to three-pass rolling into a thickness of 4.0 mm so that the finish rolling end temperature was 900° C. After the completion of finish rolling and coiling, a temperature holding equivalent treatment of 600° C.×1 h was applied. Thereafter, the sheet was cold-rolled at a reduction of 70% into a cold-rolled steel sheet having a thickness of 1.2 mm.

These cold-rolled steel sheets were subjected to recrystallization annealing under various conditions, then rapidly cooled to a temperature region of from 450 to 500° C., and immersed in a hot-dip galvanizing bath (0.13 wt. % Al—Zn bath), thereby forming a hot-dip galvanizing layer on the surface. Then, the galvanized steel sheet was reheated to a temperature range of from 450 to 550° C. to apply an alloying treatment of the hot-dip galvanizing layer (Fe content in the galvanizing layer: about 10%).

For the resultant hot-dip galvanized steel sheet, tensile properties were investigated through a tensile test. An investigation was conducted on strain age hardening properties of these galvanized steel sheets.

Tensile properties were determined by first sampling test pieces from these hot-dip galvanized steel sheets, applying a pre-strain treatment with a tensile prestrain of 5% to these test pieces, then performing a heat treatment of 50 to 350° C.×20 minutes, and then conducting a tensile test. The strain age hardening properties were evaluated in terms of the tensile strength increment ΔTS from before to after heat treatment, as described in the section of hot-rolled steel sheet.

Figure 7:
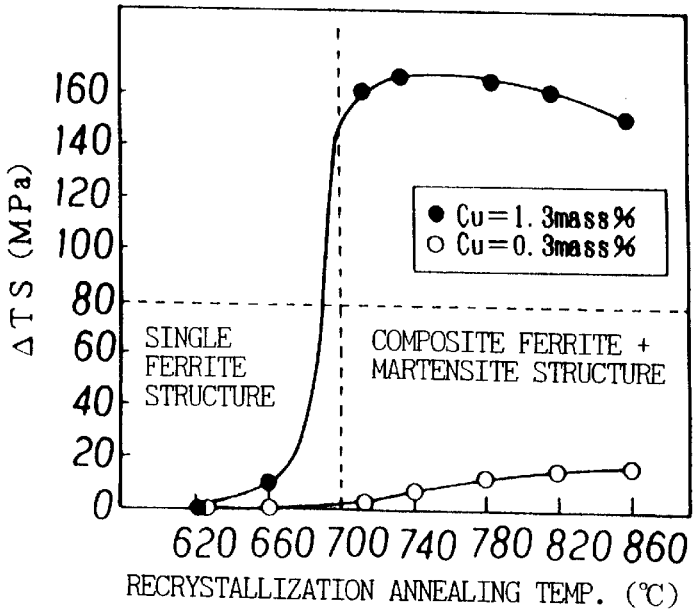
FIG. 7 is a graph illustrating the effect of the Cu content on the relationship between ΔTS and the recrystallization annealing temperature after a pre-strain—heat treatment of a hot-dip galvanized steel sheet.

FIG. 7 illustrates the effect of the Cu content on the relationship between ΔTS of the hot-dip galvanized steel sheet and the recrystallization annealing temperature. The value of ΔTS was determined by applying a pre-strain treatment with a tensile prestrain of 5% to test pieces sampled from the resultant hot-dip galvanized steel sheets, conducting a heat treatment of 250° C.×20 minutes, and carrying out a tensile test.

FIG. 7 suggests that a high strain age hardening property as represented by a ΔTS of 80 MPa or more is available, in the case of a Cu content of 1.3 wt. %, by using a recrystallization annealing temperature of 700° C. or more to convert the steel sheet structure into a composite ferrite+martensite structure. On the other hand, in the case of a Cu content of 0.3 wt. %, a high strain age hardening property is unavailable because ΔTS is under 80 MPa at any recrystallization annealing temperature. FIG. 7 suggests the possibility to manufacture a hot-dip galvanized steel sheet having a high strain age hardening property by optimizing the Cu content and achieving a composite ferrite+martensite structure.

Figure 8:
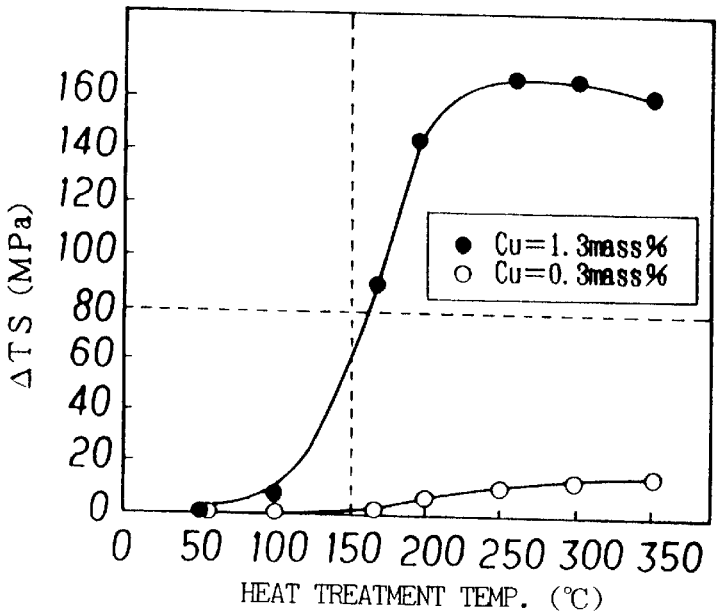
FIG. 8 is a graph illustrating the effect of the Cu content on the relationship between ΔTS and the heat treatment temperature after a pre-strain-heat treatment of a hot-dip galvanized steel sheet.

FIG. 8 illustrates the effect of the Cu content on the relationship between ΔTS of the hot-dip galvanized steel sheet and the heat treatment temperature after a pre-strain treatment. The value of ΔTS was determined on hot-dip galvanized steel sheets manufactured by applying annealing at 800° C. for a holding time of 40 seconds in the ferrite+austenite dual phase region as recrystallization annealing conditions to cold-rolled steel sheet, at various heat treatment temperatures after pre-strain treatment. The microstructure after annealing was a composite ferrite+martensite structure having a martensite area ratio of 7%.

It is known from FIG. 8 that ΔTS increases according as the heat treatment temperature increases, and the increment thereof largely depends upon the Cu content. With a Cu content of 1.3 wt. %, a high strain age hardening property as represented by a ΔTS of 80 MPa or more is available at a heat treatment temperature of 150° C. or more. For a Cu content of 0.3 wt. %, ΔTS is under 80 MPa at any heat treatment temperature, and a high strain age hardening property cannot be obtained.

For steel sheets as cold-rolled having a Cu content of 0.3 or 1.3 wt. % recrystallization annealing was performed under various recrystallization annealing conditions after cold rolling. The sheets were then rapidly cooled to a temperature region of from 450 to 500° C., then immersed in a hot-dip galvanizing bath (0.13 wt. % Al—Zn bath) to form a hot-dip galvanizing layer on the surface thereof, and the structure was converted from ferrite+martensite to a single ferrite phase. Then, the sheet was reheated to a temperature range of from 450 to 550° C. to apply an alloying treatment (Fe content in the galvanizing layer: about 10%) to the hot-dip galvanizing layer. Materials (steel sheet) limiting the yield ratio YR (=(yield strength YS/tensile strength TS)×100%) within a range of from 50 to 90% were thus obtained.

For these materials (steel sheets), a hole expanding test was carried out to determine the hole expanding ratio (λ). In the hole expanding test, the hole expanding ratio λ was determined by forming a punch hole in a test piece by punching with a punch having a diameter of 10 mm, expanding the hole until production of cracks running through the thickness so that burs are produced on the outside by means of a conical punch having a vertical angle of 60°. The hole expanding ratio λ was calculated by a formula: $\lambda(\%)=\{(d-d_0)/d_0\}\times 100$, where $d_0$: initial hole diameter, and d: inner hole diameter upon occurrence of cracks.

Figure 9:
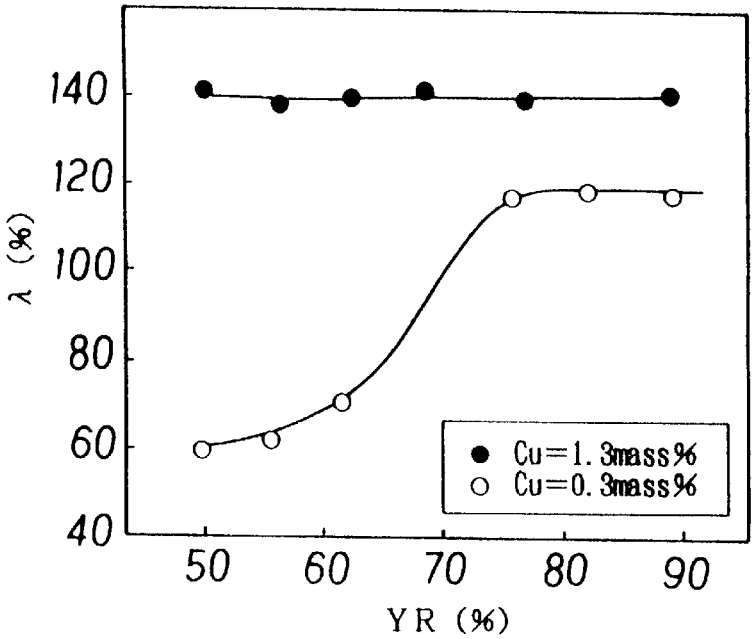
FIG. 9 is a graph illustrating the effect of the Cu content on the relationship between λ and YR of a hot-dip galvanized steel sheet.

These results on the hot-dip galvanized steel sheet, arranged in terms of the relationship between the hole expanding ratio λ and the yield ratio YR, to serve as the effect of the Cu content on the relationship between the hole expanding ratio YR of the cold-rolled steel sheet are illustrated in FIG. 9.

According to FIG. 9, in a steel sheet having a Cu content of 0.3 wt. %, achievement of a composite ferrite+martensite structure and a YR of under 70% lead to a decrease in λ along with a decrease in YR. In a steel sheet having a Cu content of 1.3 wt. %, a high λ-value is maintained even when a composite ferrite+martensite structure is achieved and a low YR is kept. On the other hand, a low YR and a high λ cannot simultaneously be obtained in the steel sheet having a Cu content of 0.3 wt. %.

It is known from FIG. 9 that a hot-dip galvanized steel sheet satisfying both a low yield ratio and a high hole expanding ratio can be manufactured by using a Cu content within an appropriate range and achieving a composite ferrite+martensite structure.

In the hot-dip galvanized steel sheet of the invention, very fine Cu precipitates in the steel sheet as a result of a pre-strain with an amount of strain larger than 2% which is the amount of prestrain upon measuring the deformation stress increment from before to after a usual heat treatment, and a heat treatment within a relatively low temperature region as from 150 to 350° C. According to a study carried out by the present inventors, a high strain age hardening property bringing about an increase in yield stress and a remarkable increase in tensile strength is considered to have been obtained from this precipitation of very fine Cu. Such precipitation of very fine Cu by a heat treatment in a low-temperature region has never been observed in ultra-low carbon steel or low-carbon steel in reports so far released. The reason of precipitation of very fine Cu by a heat treatment in a low-temperature region has not as yet been clarified to date. A conceivable reason is that, during annealing in the α+γ dual phase, much Cu is distributed in the γ-phase, and the distributed Cu is kept even after cooling in an super-saturated solid-solution state of Cu in martensite, which precipitates in a very fine form as a result of imparting of a prestrain of 5% or more and a low-temperature heat treatment.

A detailed mechanism which give a high hole expanding ratio of the steel sheet added with Cu and having a composite ferrite+martensite structure is not clearly known at present, but it is considered to be due to the fact that addition of Cu reduced the difference in hardness between ferrite and martensite.

On the basis of the novel findings described above, the present inventors carried out further studies and obtained findings that the aforementioned phenomenon could take place also in a hot-dip galvanized steel sheet not containing Cu. According to these new findings, imparting of a pre-strain and application of a heat treatment at a low temperature causes strain-induced precipitation of very fine carbides in martensite by adding one or more of Mo, Cr and W in place of Cu and converting the structure into a composite ferrite+martensite structure. Strain-induced fine precipitation upon heating at a low temperature is more remarkable by further adding one or more of Nb, V and Ti in addition to one or more of Mo, Cr and W.

The hot-dip galvanized steel sheet of the invention has a hot-dip galvanizing layer or an alloying hot-galvanizing layer formed on the surface thereof, and is a high-strength hot-dip galvanized steel sheet having a tensile strength TS of 440 MPa or more, and excellent in press-formability. Tensile strength thereof remarkably increases through a heat treatment applied at a relatively low temperature after press-forming to have an excellent strain age hardening property as represented by a ΔTS of 80 MPa or more. The steel sheet may be a hot-rolled steel sheet or a cold-rolled steel sheet.

The structure of the hot-dip galvanized steel sheet of the invention will now be described.

The hot-dip galvanized steel sheet of the invention has a composite structure comprising a ferrite phase and a secondary phase containing martensite phase having an area ratio of 2% or more relative to the entire structure.

In order to obtain a hot-dip galvanized steel sheet having a low yield strength YS and a high elongation El, and excellent in press-formability, in the invention, it is necessary to convert the structure of the hot-dip galvanized steel sheet of the invention into a composite structure comprising a ferrite phase which is the main phase and a secondary phase containing martensite. Ferrite serving as the main phase should preferably have an area ratio of 50% or more. With ferrite of under 50%, it is difficult to keep a high elongation, resulting in a lower press-formability. When a satisfactory elongation is required, the area ratio of the ferrite phase should preferably be 80% or more. For the purpose of making full use of advantages of the composite structure, the ferrite phase should preferably be 98% or less.

In the hot-dip galvanized steel sheet of the invention, steel must contain martensite as the secondary phase in an area ratio of 2% or more. An area ratio of martensite of under 2% cannot simultaneously satisfy a low YS and a high El. The secondary phase may be a single martensite phase having an area ratio of 2% or more, or may be a mixture of a martensite phase of an area ratio of 2% or more and a sub phase comprising a pearlite phase, a bainite phase, or a residual austenite phase.

The hot-dip galvanized steel sheet having the above-mentioned structure thus becomes a steel sheet excellent in press-formability, with a low yield strength and a high elongation, and in strain age hardening property.

The reasons of limiting the chemical composition of the hot-dip galvanized steel sheet of the invention will now be described. The weight percentage, wt. %, will hereafter be denoted simply as %.

C: 0.15% or less:

C is an element which improves strength of a steel sheet, and promotes formation of a composite structure of ferrite and martensite, and should preferably be contained in an amount of 0.01% or more for forming a composite ferrite+martensite structure in the invention. A C content of over 0.15% on the other hand causes an increase in partial ratio of carbides in steel, resulting in a decrease in elongation, and hence a decrease in press-formability. A more important problem is that a C content of over 0.15% leads to a serious decrease in spot weldability and arc weldability. For these reasons, in the invention, the C content is limited to 0.15% or less. From the point of view of formability, the C content should more preferably be 0.10% or less.

Si: 2.0% or less:

Si is a useful strengthening element which can improve strength of a steel sheet without causing a marked decrease in elongation of the steel sheet. A Si content of over 2.0% however leads to deterioration of press-formability and degrades platability. The Si content is therefore limited to 2.0% or less, and preferably, 0.1% or more.

Mn: 3.0% or less:

Mn has a function of strengthening steel, reducing the critical cooling rate for obtaining a composite ferrite+martensite structure, and of accelerating formation of the composite ferrite+martensite structure. Mn is an element effective for preventing hot cracking caused by S, and should therefore be contained in an amount dependent upon the S content. These effects are particularly remarkable at an Mn content of 0.5% or more. On the other hand, an Mn content of over 3.0% results in deterioration of press-formability and weldability. The Mn content is therefore limited to 3.0% or less, and more preferably, to 1.0% or more.

P: 0.10% or less:

P has a function of strengthening steel, and can be contained in an amount necessary for a desired strength. An excessive P content however causes deterioration of press-formability. The P content is therefore limited to 0.10% or less. When a further higher press-formability is required, the P content should preferably be 0.08% or less.

S: 0.02% or less:

S is an element which is present as inclusions in steel and causes deterioration of elongation, formability, and particularly stretch flanging formability of a steel sheet. It should therefore be the lowest possible. A S content reduced to 0.02% or less does not exert much adverse effect. In the invention, therefore, the S content is limited to 0.02% or less. When an excellent stretch flanging formability is required, the S content should preferably be 0.010% or less.

Al: 0.10% or less:

Al is an element which is added as a deoxidizing element of steel, and is useful for improving cleanliness of steel. However, an Al content of over 0.10% cannot give a further deoxidizing effect, but causes in contrast deterioration of press-formability. The Al content is therefore limited to 0.10% or less. The invention does not exclude a steelmaking process based on a deoxidation by means of a deoxidizer other than Al. For example, Ti deoxidation or Si deoxidation may be used, and steel sheets produced by such deoxidation methods are also included in the scope of the invention.

N: 0.02% or less:

N is an element which increases strength of a steel sheet through solid-solution strengthing or strain age hardening. A N content of over 0.02% however causes an increase in the content of nitrides in the steel sheet, which in turn causes a serious deterioration of elongation, and furthermore, of press-formability. The N content is therefore limited to 0.02% or less. When further improvement of press-formability is required, the N content should suitably be 0.01% or less, and preferably 0.0005% or more.

Cu: from 0.5 to 3.0%:

Cu is an element which remarkably increases strain age hardening of the hot-dip galvanized steel sheet of the invention (increase in strength after pre-strain—heat treatment), and is one of the most important elements in the invention. With a Cu content of under 0.5%, an increase in tensile strength of over ΔTS: 80 MPa cannot be obtained even by using different pre-determination—heat treatment conditions. In the invention, therefore, Cu should be contained in an amount of 0.5% or more. With a Cu content of over 3.0%, on the other hand, the effect is saturated so that an effect corresponding to the content cannot be expected, leading to unfavorable economic effects. Deterioration of press-formability results, and the surface quality of the steel sheet is degraded. The Cu content is therefore limited within a range of from 0.5 to 3.0%. In order to simultaneously achieve a higher ΔTS and an excellent press-formability, the Cu content should preferably be within a range of from 1.0 to 2.5%.

In the hot-dip galvanized steel sheet of the invention, in addition to the chemical composition containing Cu as described above, it is desirable to contain one or more of the following groups A to C:

group A: Ni: 2.0% or less;

group B: one or two of Cr and Mo: 2.0% or less in total; and group C: one or more of Nb, Ti and V: 0.2% or less in total.

Group A: Ni: 2.0% or less:

Group A: Ni is an element effective for preventing surface defects produced on the steel sheet surface upon adding Cu, and can be contained as required. If contained, the Ni content, depending upon the Cu content, should preferably be about a half the Cu content. A Ni content of over 2.0% cannot give a corresponding effect because of saturation of the effect, leading to economic disadvantages, and causes deterioration of press-formability. The Ni content should preferably be limited to 2.0% or less.

Group B: one or two of Cr and Mo: 2.0% or less in total:

Group B: As in Mn, both Cr and Mo have a function of reducing the critical cooling rate for obtaining a composite ferrite+martensite structure and promoting formation of a composite ferrite+martensite structure, and can be contained as required. If one or two of Cr and Mo are contained in an amount of over 2.0% in total, there occurs a decrease in press-formability. It is therefore desirable to limit the total content of one or two of Cr and Mo forming group B to 2.0% or less.

Group C: one or more of Nb, Ti and V: 0.2% or less in total:

Group C: Nb, Ti and v are carbide-forming elements which effectively act to increase strength through fine dispersion of carbides, and can be selected and contained as required. However, if the total content of one or more of Nb, Ti and V is over 0.2%, there occurs deterioration of press-formability. The total content of Nb, Ti and/or V should therefore preferably be limited to 0.2% or less.

In the hot-dip galvanized steel sheet of the invention, in place of the aforementioned Cu, one or more selected from the group consisting of from 0.05 to 2.0% Mo, from 0.05 to 2.0% Cr, and from 0.05 to 2.0% W may be contained in an amount of 2.0% or less in total, or further one or more selected from the group consisting of Nb, Ti and V in an amount of 2.0% or less in total.

One or more selected from the group consisting of from 0.05 to 2.0% Mo, from 0.05 to 2.0% Cr and from 0.05 to 2.0% W, in an amount of 2.0% or less in total:

Mo, Cr and W are elements which cause a remarkable increase in strain age hardening of a steel sheet, are the most important elements in the invention, and can be selected and contained as required. Containing one or more of Mo, Cr and W, and achievement of a composite ferrite +martensite structure cause strain-induced fine precipitation of fine carbides during pre-strain—heat treatment, thus making it possible to obtain a tensile strength as represented by a ΔTS of 80 MPa or more. With a content of each of these elements of under 0.05%, changing of pre-strain—heat treatment conditions or the steel sheet structure does not give an increase in tensile strength represented by a ΔTS of 80 MPa or more. On the other hand, even if the content of each of these elements is over 2.0%, an effect corresponding to the content cannot be expected as a result of saturation of the effect, leading to economic disadvantages, and this results in deterioration of press-formability. The contents of Mo, Cr and W are therefore limited within a range of from 0.05 to 2.0% for Mo, from 0.05 to 2.0% for Cr, and from 0.05 to 2.0% for W. From the point of view of press-formability, the total content of Mo, Cr and W is limited to 2.0% or less.

One or more of Nb, Ti and V: 2.0% or less in total:

Nb, Ti and V are carbide-forming elements, and, when containing one or more of Mo, Cr and W, can be selected and contained as required. Containing one or more of Nb, Ti and V, and achievement of a composite ferrite+martensite structure cause strain-induced fine precipitation of fine carbides during pre-strain—heat treatment, thus making it possible to obtain a tensile strength as represented by a ΔTS of 80 MPa or more. However, a total content of one or more of Nb, Ti and V of over 2.0% causes deterioration of press-formability. The total content of Nb, Ti and/or V should therefore preferably be limited to 2.0% or less.

Apart from the above-mentioned elements, one or two of 0.1% or less Ca and 0.1% or less REM may be contained. Ca and REM are elements contributing to improvement of elongation through shape control of inclusions. If the Ca content is over 0.1% and the REM content is over 0.1%, however, there would be a decrease in cleanliness, and a decrease in elongation.

From the point of view of forming martensite, one or two of 0.1% or less B and 0.1% or less Zr may be contained.

The balance except for the above-mentioned elements comprises Fe and incidental impurities. Allowable incidental impurities include 0.01% or less Sb, 0.01% or less Pb, 0.1% or less Sn, 0.01% or less Zn, and 0.1% or less Co.

The manufacturing method of the hot-dip galvanized steel sheet of the invention will now be described.

The hot-dip galvanized steel sheet of the invention is manufactured by annealing the steel sheet having the aforementioned chemical composition through heating to ferrite+austenite dual phase region within a temperature region of from $Ac_3$ transformation point to $Ac_1$ transformation point on a line for continuous hot-dip galvanizing, and applying a hot-dip galvanizing treatment, thereby forming a hot-dip galvanizing layer on the surface of the steel sheet.

A hot-rolled steel sheet or a cold-rolled steel sheet may be used.

A preferable manufacturing method of the steel sheet used will be described. It is needless to mention that the manufacturing method of the hot-dip galvanized steel sheet of the invention is not limited to the described one.

First, the manufacturing method suitable for the hot-rolled steel sheet used as a galvanizing substrate will be described.

The material used (steel slab) should preferably be prepared by making molten steel having the aforementioned chemical composition by a conventionally known process, and for preventing macro-segregation of the elements, a steel slab should preferably be manufactured by the continuous casting process. The ingot making process or the thin-slab continuous casting process is applicable. Apart from the conventional process comprising the steps of manufacturing a steel slab, the cooling the steel slab once to room temperature, and the reheating the slab, an energy-saving process of charging the hot steel slab into a reheating furnace without cooling the same, or after a slight temperature holding, immediately rolling as in direct-hot-charge rolling or direct rolling is applicable with no problem.

The above-mentioned material (steel slab) is reheated, and rolled into a hot-rolled sheet through application of the hot rolling step. No particular problem is encountered as to conventionally known conditions so far as such conditions permit manufacture of a hot-rolled steel sheet having a desired thickness in the hot rolling step. Preferable conditions for hot rolling are as follows:

Slab reheating temperature: 900° C. or more

With a reheating temperature of under 900° C., there is an increase in the rolling load, thus increasing the risk of occurrence of troubles during hot rolling. When Cu is contained, the slab reheating temperature should preferably be the lowest possible to prevent surface defects caused by Cu. Considering the increase in scale loss caused along with the increase in weight loss of oxidation, the slab reheating temperature should preferably be 1,300° C. or below.

From the point of view of reducing the slab reheating temperature and preventing occurrence of troubles during hot rolling, use of a so-called sheet bar heater based on heating a sheet bar is of course an effective method.

Finish rolling end temperature: 700° C. or more:

By adopting a finish rolling end temperature FDT of 700° C. or more, it is possible to obtain a uniform structure of the hot-rolled mother sheet. On the other hand, a finish rolling end temperature of under 700° C. leads to a non-uniform structure of the hot-rolled mother sheet and a higher rolling load during hot rolling, thus increasing the risk of occurrence of troubles during hot rolling. The FDT for the hot rolling step should therefore preferably be 700° C. or more.

Coiling temperature: 800° C. or below:

The coiling temperature CT should preferably be 800° C. or below, and more preferably, 200° C. or more. A coiling temperature of over 800° C. tends to cause a decrease in yield as a result of scale loss due to an increase of scale. With a coiling temperature of under 200° C., the steel sheet shape is seriously disturbed, and there is an increasing risk of occurrence of inconveniences in practical use.

The hot-rolled steel sheet suitably applicable in the invention should preferably be prepared by reheating the slab having the aforementioned chemical composition to 900° C. or more, subjecting the same to hot rolling so that the finish rolling end temperature becomes 700° C. or more and coiling the same at a coiling temperature of 800° C. or more, and preferably, 200° C. or more.

In the hot rolling step, all or part of finish rolling may comprise lubrication rolling to reduce the rolling load during hot rolling. Application of lubrication rolling is effective also from the point of view of achieving a uniform steel sheet shape and a uniform material quality. The frictional coefficient upon lubrication rolling should preferably be within a range of from 0.25 to 0.10. It is desirable to convert neighboring sheet bars to form a continuous rolling process for continuously carrying out finish rolling. Application of the continuous rolling process is desirable also from the point of view of operational stability of hot rolling.

The hot-rolled sheet with scale adhering thereto may be subjected to hot-rolled sheet annealing to form an internal oxide film in the surface layer of the steel sheet. Formation of the internal oxide layer improves hot-dip galvanizing property for preventing surface concentration of Si, Mn and P.

The hot-rolled sheet manufactured by the above-mentioned method may be used as an mother sheet for plating, and moreover, the cold-rolled sheet manufactured by applying cold rolling step to the above-mentioned hot-rolled sheet.

In the cold rolling step, cold rolling is applied to the hot-rolled sheet. Any cold rolling conditions may be used so far as such conditions permit production of cold-rolled steel sheets of desired dimensions and shape, and no particular restriction is imposed. The reduction in cold rolling should preferably be 40% or more. A reduction of under 40% makes it difficult for recrystallization to take place uniformly during annealing, the next step.

In the present invention, the above-mentioned hot-rolled or cold-rolled (steel) sheet should preferably be subjected to annealing of heating the sheet to a ferrite ($\alpha$)+austenite ($\gamma$) dual-phase region within a temperature range of from $Ac_1$ transformation point to $Ac_3$ transformation point on a continuous hot-dip galvanizing line.

A heating temperature of under $Ac_1$ transformation point leads to a ferrite single-phase structure. A heating temperature of over $Ac_3$ transformation point results in coarsening of crystal grains and in an austenite single-phase structure, causing serious deterioration of press-formability. Annealing in the ($\alpha+\gamma$) dual-phase region makes it possible to obtain a composite ferrite+martensite structure and a high $\Delta$TS.

In order to obtain a composite ferrite+martensite structure, cooling should preferably be carried out from the dual-phase region heating temperature to the hot-dip galvanizing treatment temperature at a cooling rate of 5° C./second or more. With a cooling rate of under 5° C./second, it becomes difficult for martensite transformation to take place and to achieve a composite ferrite+martensite structure.

The hot-dip galvanizing treatment may be carried out under treatment conditions (galvanizing bath temperature: 450 to 500° C.) commonly used in a usual continuous hot-dip galvanizing line, and it is not necessary to impose a particular restriction. Because galvanizing at an excessively high temperature leads to a poor platability, galvanizing should preferably be conducted at a temperature of 500° C. or below. Galvanizing at a temperature of under 450° C. poses a problem of deterioration of platability.

With a view to forming martensite, the cooling rate from the hot-dip galvanizing temperature to 300° C. should preferably be 5° C./second or more.

For the purpose of adjusting the galvanizing weight as required after galvanizing, wiping may be performed.

After hot-dip galvanizing, an alloying treatment of the hot-dip galvanizing layer may be applied. The alloying treatment of the hot-dip galvanizing layer should preferably be carried out by reheating the sheet to a temperature region of from 460 to 560° C. after the hot-dip galvanizing treatment. An alloying treatment at a temperature of over 560° C. causes deterioration of platability. On the other hand, an alloying treatment at a temperature of under 460° C. causes a slower progress of alloying, hence deterioration of productivity.

In the manufacturing method of the hot-dip galvanized steel sheet of the invention, application of a preheating treatment for heating the sheet to a temperature of 700° C. or more on the continuous annealing line, and then, a pretreatment step of pickling for removing a concentrated layer of the elements in steel formed during the preheating treatment is desirable for improving platability.

On the surface of the steel sheet preheated on the continuous annealing line, P in steel is concentrated, and oxides of Si, Mn and Cr are concentrated, forming a surface concentration layer. It is favorable for improving platability to remove this surface concentration layer through pickling and to conduct annealing in a reducing atmosphere subsequently on the continuous hot-dip galvanizing line. With a preheating treatment temperature of under 700° C., formation of a surface concentration layer is not promoted, and improvement of platability is not accelerated. At preheating temperature of 1,000° C. or below is desirable from the point of view of press-formability.

After the hot-dip galvanizing or the alloying treatment, temper rolling of 10% or less may be applied for adjustments such as shape correction and surface roughness adjustment.

To the steel sheet of the invention, a special treatment may be applied after the hot-dip galvanizing, for improving chemical conversion treatment property, weldability, press-formability and corrosion resistance.

EXAMPLES

Example 1

Molten steel having the chemical composition as shown in Table 1 was made in a converter, and cast into steel slabs by the continuous casting process. These steel slabs were heated, and hot-rolled under the conditions shown in Table 2 into hot-rolled steel strips having a thickness of 2.0 mm (hot-rolled steel sheets), followed by temper rolling of 1.0%. Steel sheet No. 2 was rolled by lubrication rolling on latter four stands of finish rolling.

For the thus obtained hot-rolled steel strips (hot-rolled steel sheets), the microstructure, tensile properties, strain age hardening property and hole expanding ratio were determined. Press-formability was evaluated in terms of elongation El and yield strength.

(1) Microstructure

Test pieces were sampled from the resultant steel strips, and for the cross-section (section C) perpendicular to the rolling direction, microstructure was shot by means of an optical microscope or a scanning type electron microscope, and the structural partial ratio of ferrite, the main phase, and the kind and structural partial ratio of the secondary phase were determined by use of an image analyzer.

(2) Tensile Properties

JIS #5 tensile test pieces were sampled from the resultant steel strips (hot-rolled sheets), and a tensile test was carried out in accordance with JIS Z2241 to determine yield strength YS, tensile strength TS, elongation El and yield ratio YR.

(3) Strain Age Hardening Property

JIS #5 tensile test pieces were sampled in the rolling direction from the resultant steel strips (hot-rolled steel sheets). A plastic deformation of 5% was applied as a pre-strain (tensile prestrain), and then, after conducting a heat treatment of 250° C.×20 min., a tensile test was carried out to determine tensile properties (yield stress $YS_{HT}$, and tensile strength $TS_{HT}$) and to calculate $\Delta YS=YS_{HT}-YS$, and $\Delta TS=TS_{HT}-TS$. $YS_{HT}$ and $TS_{HT}$ are yield stress and tensile strength after the pre-strain—heat treatment, and YS and TS are yield stress and tensile strength of the steel strips (hot-rolled steel sheets).

(4) Hole Expanding Ratio

A hole was formed by punching a test piece sampled from the resultant steel strip (hot-rolled sheet) by means of a punch having a diameter of 10 mm. Then, The hole was expanded until occurrence of cracks running through the thickness by use of a conical punch having a vertical angle of 60° so that burrs were produced on the outside, thereby determining the hole expanding ratio λ. The hole expanding ratio λ was calculated by a formula: $\lambda(\%)=\{(d-d_0)/d_0\}\times 100$, where, $d_0$: initial hole diameter, and d: inner hole diameter upon occurrence of cracks.

These results are shown in Table 3.

TABLE 1

| STEEL | CHEMICAL COMPOSITION (wt. %) | | | | | | | | | | | | | | TRANSFORMATION POINT (° C.) | |
|---|---|---|---|---|---|---|---|---|---|---|---|---|---|---|---|---|
| NO. | C | Si | Mn | P | S | Al | N | Cu | Ni | Cr | Mo | Nb | Ti | V | $A_{c3}$ | $A_{c1}$ |
| A | 0.035 | 0.76 | 1.72 | 0.01 | 0.004 | 0.035 | 0.002 | 1.72 | — | — | — | — | — | — | 840 | 704 |
| B | 0.038 | 0.52 | 1.58 | 0.01 | 0.001 | 0.032 | 0.002 | 1.44 | 0.62 | — | 0.31 | — | — | — | 843 | 712 |
| C | 0.042 | 0.88 | 1.48 | 0.01 | 0.005 | 0.028 | 0.002 | 1.21 | 0.53 | 0.52 | — | — | — | — | 841 | 713 |
| D | 0.039 | 1.05 | 1.61 | 0.01 | 0.005 | 0.033 | 0.002 | 1.38 | 0.42 | — | — | 0.01 | 0.01 | 0.01 | 842 | 706 |
| E | 0.036 | 0.88 | 1.82 | 0.01 | 0.006 | 0.033 | 0.002 | 0.15 | — | — | — | — | — | — | 830 | 705 |
| F | 0.036 | 0.62 | 1.75 | 0.01 | 0.004 | 0.032 | 0.002 | 0.72 | — | — | — | — | — | — | 840 | 706 |
| G | 0.039 | 0.71 | 1.66 | 0.01 | 0.003 | 0.033 | 0.002 | 0.95 | — | — | — | — | — | — | 843 | 705 |

TABLE 2

| | | | HOT ROLLING - COOLING AFTER ROLLING | | | | |
|---|---|---|---|---|---|---|---|
| STEEL SHEET NO. | STEEL NO. | SLAB REHEATING TEMP. SRT ° C. | FINISH ROLLING END TEMP. FDT ° C. | COOLING RATE FROM $A_{r3}$ TO $A_{r1}$ ° C./s | AIR COOLING/ SLOW COOLING BETWEEN $A_{r3}$ AND $A_{r1}$ s | COOLING RATE BEFORE COILING ° C. | COILING TEMP CT ° C. |
| 1 | A | 1150 | 850 | 30 | 5 | 30 | 450 |
| 2 | B | 1150 | 850 | 30 | 5 | 30 | 450 |
| 3 | B | 1150 | 850 | 10 | 0 | 20 | 600 |
| 4 | B | 1150 | 700 | 10 | 0 | 10 | 450 |
| 5 | C | 1150 | 850 | 30 | 5 | 30 | 450 |
| 6 | D | 1150 | 850 | 30 | 5 | 30 | 450 |
| 7 | E | 1150 | 850 | 30 | 5 | 30 | 450 |
| 8 | F | 1150 | 850 | 30 | 5 | 30 | 450 |
| 9 | G | 1150 | 850 | 30 | 5 | 30 | 450 |

TABLE 3

| STEEL SHEET NO. | STEEL NO. | MICROSTRUCTURE FERRITE AREA RATIO % | SECONDARY PHASE KIND | SECONDARY PHASE MARTENSITE % | SECONDARY PHASE AREA RATIO % | HOT-ROLLED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 1 | A | 93 | M | 7 | 7 | 350 | 630 | 31 | 56 | 700 | 780 | 350 | 150 | 145 | EXAMPLE |
| 2 | B | 90 | M | 10 | 10 | 365 | 660 | 29 | 55 | 740 | 820 | 375 | 160 | 140 | EXAMPLE |
| 3 | B | 80 | P | 0 | 20 | 670 | 730 | 13 | 92 | 720 | 760 | 50 | 30 | 70 | COMPARATIVE EXAMPLE |
| 4 | B | 100 | — | 0 | 0 | 470 | 670 | 12 | 70 | 580 | 695 | 110 | 25 | 60 | COMPARATIVE EXAMPLE |
| 5 | C | 92 | M | 8 | 8 | 355 | 650 | 30 | 55 | 720 | 800 | 365 | 150 | 140 | EXAMPLE |
| 6 | D | 91 | M | 9 | 9 | 365 | 670 | 29 | 54 | 730 | 815 | 365 | 145 | 135 | EXAMPLE |
| 7 | E | 92 | M | 8 | 8 | 300 | 530 | 36 | 57 | 480 | 550 | 180 | 20 | 60 | COMPARATIVE EXAMPLE |
| 8 | F | 90 | M | 10 | 10 | 335 | 610 | 32 | 55 | 660 | 740 | 325 | 130 | 140 | EXAMPLE |
| 9 | G | 92 | M | 8 | 8 | 340 | 620 | 31 | 55 | 680 | 755 | 340 | 135 | 135 | EXAMPLE |

M: MARTENSITE;
P: PEARLITE;
B: BAINITE

All Examples of the invention showed a low yield strength YS, a high elongation El, a low yield ratio YR, and a high hole expanding ratio λ, suggesting that these hot-rolled steel sheets have an excellent press-formability including stretch flanging formability, and showed high ΔYS, and a very large ΔTS, suggesting to have an excellent strain age hardening property. Comparative Examples outside the scope of the invention, in contrast, suggest that the samples are hot-rolled steel sheets having decreased press-formability and strain age hardening property as having a high yield strength YS, a low elongation El, a small hole expanding ratio λ, or a low ΔTS,.

Example 2

Molten steel having the chemical composition as shown in Table 4 was made in a converter and cast into steel slabs by the continuous casting process. These steel slabs were reheated, and hot-rolled under conditions shown in Table 5 into hot-rolled steel strips (hot-rolled sheets) having a thickness of 2.0 mm, followed by temper rolling of a reduction of 1.0%.

For the resultant hot-rolled steel strips (hot-rolled steel sheets), microstructure, tensile properties, strain age hardening property and hole expanding ratio were determined as in Example 1.

The results are shown in Table 6.

TABLE 4

| STEEL NO. | CHEMICAL COMPOSITION (wt. %) C | Si | Mn | P | S | Al | N | Cr | Mo | W | Nb | Ti | V | TRANSFORMATION POINT (° C.) $A_{c3}$ | $A_{c1}$ |
|---|---|---|---|---|---|---|---|---|---|---|---|---|---|---|---|
| H | 0.056 | 0.29 | 1.52 | 0.01 | 0.004 | 0.033 | 0.002 | 0.13 | 0.45 | — | — | — | — | 820 | 705 |
| I | 0.058 | 0.68 | 1.58 | 0.01 | 0.003 | 0.032 | 0.002 | — | 0.31 | — | 0.04 | — | 0.05 | 830 | 715 |
| J | 0.053 | 0.58 | 1.48 | 0.01 | 0.005 | 0.029 | 0.002 | — | 0.45 | — | 0.04 | 0.03 | — | 835 | 710 |
| K | 0.049 | 0.72 | 1.88 | 0.01 | 0.001 | 0.033 | 0.002 | — | — | 0.52 | — | — | — | 825 | 710 |
| L | 0.051 | 1.02 | 1.62 | 0.01 | 0.004 | 0.031 | 0.002 | — | 0.35 | — | — | 0.04 | — | 820 | 705 |
| M | 0.052 | 0.88 | 1.55 | 0.01 | 0.003 | 0.031 | 0.002 | 0.48 | — | — | 0.05 | — | — | 835 | 705 |
| N | 0.055 | 0.62 | 1.88 | 0.01 | 0.004 | 0.029 | 0.002 | — | — | — | — | — | — | 835 | 705 |
| P | 0.053 | 0.59 | 1.66 | 0.01 | 0.003 | 0.029 | 0.002 | 0.48 | — | — | — | — | — | 830 | 710 |

TABLE 4-continued

| STEEL | CHEMICAL COMPOSITION (wt. %) | | | | | | | | | | | | | TRANSFORMATION POINT (° C.) | |
|---|---|---|---|---|---|---|---|---|---|---|---|---|---|---|---|
| NO. | C | Si | Mn | P | S | Al | N | Cr | Mo | W | Nb | Ti | V | $A_{c3}$ | $A_{c1}$ |
| Q | 0.052 | 0.62 | 1.78 | 0.01 | 0.004 | 0.038 | 0.002 | — | 0.58 | — | — | — | — | 825 | 705 |
| R | 0.055 | 0.61 | 1.62 | 0.01 | 0.003 | 0.033 | 0.002 | 0.19 | — | 0.28 | — | — | — | 815 | 715 |
| S | 0.054 | 0.58 | 1.82 | 0.01 | 0.004 | 0.036 | 0.002 | 0.33 | 0.22 | 0.15 | 0.04 | 0.02 | 0.05 | 820 | 720 |

TABLE 5

| | | | HOT ROLLING - COOLING AFTER ROLLING | | | | |
|---|---|---|---|---|---|---|---|
| STEEL SHEET NO. | STEEL NO. | SLAB REHEATING TEMP. SRT ° C. | FINISH ROLLING END TEMP. FDT ° C. | COOLING RATE FROM $A_{r3}$ TO $A_{r1}$ ° C./s | AIR COOLING/ SLOW COOLING BETWEEN $A_{r3}$ AND $A_{r1}$ S | COOLING RATE BEFORE COILING ° C. | COILING TEMP CT ° C. |
| 10 | H | 1150 | 850 | 30 | 5 | 30 | 450 |
| 11 | I | 1150 | 850 | 30 | 5 | 30 | 450 |
| 12 | I | 1150 | 850 | 10 | 0 | 20 | 600 |
| 13 | I | 1150 | 850 | 10 | 0 | 10 | 450 |
| 14 | J | 1150 | 850 | 30 | 5 | 30 | 450 |
| 15 | K | 1150 | 850 | 30 | 5 | 30 | 450 |
| 16 | L | 1150 | 850 | 30 | 5 | 30 | 450 |
| 17 | M | 1150 | 850 | 30 | 5 | 30 | 450 |
| 18 | N | 1150 | 850 | 30 | 5 | 30 | 450 |
| 19 | P | 1150 | 850 | 30 | 5 | 30 | 450 |
| 20 | Q | 1150 | 850 | 30 | 5 | 30 | 450 |
| 21 | R | 1150 | 850 | 30 | 5 | 30 | 450 |
| 22 | S | 1150 | 850 | 30 | 5 | 30 | 450 |

TABLE 6

| | | MICROSTRUCTURE | | | | HOT-ROLLED SHEET PROPERTIES | | | | PROPERTIES AFTER PRE-STRAIN - HEAT TREATMENT | | STRAIN AGE HARDENING PROPERTIES | | HOLE EXPANSION HOLE EXPANDING | |
|---|---|---|---|---|---|---|---|---|---|---|---|---|---|---|---|
| | | FERRITE | SECONDARY PHASE | | | TENSILE PROPERTIES | | | | | | | | | |
| STEEL SHEET NO. | STEEL NO. | AREA RATIO % | KIND | MARTENSITE % | AREA RATIO % | YS (MPa) | TS (MPa) | El (%) | YR % | $YS_{HT}$ MPa | $TS_{HT}$ MPa | ΔYS MPa | ΔTS MPa | RATIO λ % | REMARKS |
| 10 | H | 92 | M | 8 | 8 | 345 | 620 | 31 | 56 | 690 | 770 | 345 | 150 | 125 | EXAMPLE |
| 11 | I | 90 | M | 10 | 10 | 360 | 650 | 30 | 55 | 730 | 810 | 370 | 160 | 145 | EXAMPLE |
| 12 | I | 78 | P | 0 | 22 | 670 | 720 | 12 | 93 | 730 | 740 | 60 | 20 | 60 | COMPARATIVE EXAMPLE |
| 13 | I | 100 | — | 0 | 0 | 465 | 660 | 11 | 70 | 660 | 675 | 195 | 15 | 70 | COMPARATIVE EXAMPLE |
| 14 | J | 91 | M | 9 | 9 | 350 | 640 | 30 | 55 | 710 | 790 | 360 | 150 | 140 | EXAMPLE |
| 15 | K | 91 | M | 9 | 9 | 360 | 660 | 30 | 55 | 725 | 805 | 365 | 145 | 125 | EXAMPLE |
| 16 | L | 93 | M | 7 | 7 | 300 | 520 | 37 | 58 | 630 | 650 | 330 | 130 | 140 | EXAMPLE |
| 17 | M | 90 | M | 10 | 10 | 330 | 600 | 33 | 55 | 660 | 730 | 330 | 130 | 140 | EXAMPLE |

TABLE 6-continued

| STEEL SHEET NO. | STEEL NO. | MICROSTRUCTURE FERRITE AREA RATIO % | SECONDARY PHASE KIND | SECONDARY PHASE MARTENSITE % | SECONDARY PHASE AREA RATIO % | HOT-ROLLED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 18 | N | 92 | M | 8 | 8 | 335 | 610 | 32 | 55 | 550 | 640 | 215 | 30 | 70 | COMPARATIVE EXAMPLE |
| 19 | P | 93 | M | 7 | 7 | 325 | 590 | 33 | 55 | 650 | 730 | 325 | 130 | 125 | EXAMPLE |
| 20 | Q | 92 | M | 8 | 8 | 330 | 600 | 33 | 55 | 660 | 735 | 330 | 135 | 130 | EXAMPLE |
| 21 | R | 94 | M | 6 | 6 | 345 | 620 | 31 | 56 | 680 | 765 | 335 | 145 | 125 | EXAMPLE |
| 22 | S | 93 | M | 7 | 7 | 360 | 660 | 30 | 55 | 720 | 800 | 360 | 140 | 150 | EXAMPLE |

M: MARTENSITE;
P: PEARLITE;
B: BAINITE

All Examples of the invention showed a low yield strength YS, a high elongation El, a low yield ratio YR, and a high hole expanding ratio λ, suggesting that these hot-rolled steel sheets have an excellent press-formability including stretch flanging formability, and showed a high ΔYS and a very large ΔTS, suggesting to have an excellent strain age hardening property. Comparative Examples outside the scope of the invention, in contrast, suggest that the samples are hot-rolled steel sheets having decreased press-formability and strain age hardening property as having a high yield strength YS, a low elongation El, a small hole-expanding ratio λ or a low ΔTS,.

Example 3

Molten steel having the chemical composition as shown in Table 7 was made in a converter and cast into steel slabs by the continuous casting process. These steel slabs were reheated to 1,150° C. as shown in Table 8, and then hot-rolled in a hot rolling step with a finish rolling end temperature of 900° C. and a coiling temperature of 600° C. into hot-rolled steel strips (hot-rolled steel sheets) having a thickness of 4.0 mm. The steel sheet No. 2-2 was lubrication-rolled through the latter four stands of finish rolling. Then, these hot-rolled steel strips (hot-rolled sheets) were subjected to a cold rolling step for cold pickling and cold rolling into cold-rolled steel strips (cold-rolled sheets) having a thickness of 1.2 mm. Then, recrystallization annealing was applied to these cold-rolled steel strips (cold-rolled sheet) on a continuous annealing line, at an annealing temperature shown in Table 8. The resultant steel strips (cold-rolled annealed sheets) were subjected to temper rolling at an elongation of 0.8%.

Test pieces were sampled from the resultant steel strips, and microstructure, tensile properties, strain age hardening property and hole expanding property were investigated as in Example 1. Press-formability was evaluated in terms of elongation El, yield strength and hole expanding ratio.

The results are shown in Table 9.

TABLE 7

| STEEL NO. | CHEMICAL COMPOSITION (wt. %) C | Si | Mn | P | S | Al | N | Cu | Ni | Cr | Mo | Nb | Ti | V | TRANSFORMATION POINT (° C.) $A_{c1}$ | $A_{c3}$ |
|---|---|---|---|---|---|---|---|---|---|---|---|---|---|---|---|---|
| 2A | 0.035 | 0.02 | 1.72 | 0.01 | 0.004 | 0.035 | 0.002 | 1.52 | — | — | — | — | — | — | 705 | 850 |
| 2B | 0.038 | 0.02 | 1.58 | 0.01 | 0.001 | 0.032 | 0.002 | 1.44 | 0.62 | — | 0.11 | — | — | — | 710 | 850 |
| 2C | 0.042 | 0.03 | 1.48 | 0.01 | 0.005 | 0.028 | 0.002 | 1.21 | 0.53 | 0.12 | — | — | — | — | 710 | 855 |
| 2D | 0.039 | 0.02 | 1.61 | 0.01 | 0.005 | 0.033 | 0.002 | 1.38 | 0.42 | — | — | 0.01 | 0.01 | 0.01 | 705 | 845 |
| 2E | 0.036 | 0.02 | 1.82 | 0.01 | 0.006 | 0.033 | 0.002 | 0.25 | — | — | — | — | — | — | 705 | 835 |
| 2F | 0.032 | 0.02 | 1.72 | 0.01 | 0.003 | 0.031 | 0.002 | 0.72 | — | — | — | — | — | — | 705 | 855 |
| 2G | 0.033 | 0.02 | 1.65 | 0.01 | 0.004 | 0.032 | 0.002 | 0.95 | — | — | — | — | — | — | 706 | 850 |

TABLE 8

| STEEL SHEET NO. | STEEL NO. | SLAB REHEATING TEMP. (° C.) | HOT ROLLING STEP FINISH ROLLING END TEMP. FDT ° C. | HOT ROLLING STEP COILING TEMP. CT ° C. | COLD ROLLING STEP COLD ROLLING REDUCTION % | RECRYSTALLIZATION ANNEALING ANNEALING TEMP. (° C.) |
|---|---|---|---|---|---|---|
| 2-1 | 2A | 1150 | 900 | 600 | 70 | 800 |
| 2-2 | 2B | | | | | 800 |
| 2-3 | 2B | | | | | 980 |
| 2-4 | 2B | | | | | 680 |
| 2-5 | 2C | | | | | 800 |
| 2-6 | 2D | | | | | 800 |
| 2-7 | 2E | | | | | 800 |
| 2-8 | 2F | 1150 | 900 | 600 | 70 | 800 |
| 2-9 | 2G | 1150 | 900 | 600 | 70 | 800 |

TABLE 9

| STEEL SHEET NO. | STEEL NO. | MICROSTRUCTURE FERRITE AREA RATIO % | MICROSTRUCTURE SECONDARY PHASE KIND | MICROSTRUCTURE SECONDARY PHASE MARTENSITE AREA RATIO % | MICROSTRUCTURE SECONDARY PHASE AREA RATIO % | COLD-ROLLED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 2-1 | 2A | 93 | M | 7 | 7 | 345 | 620 | 31 | 56 | 690 | 770 | 345 | 150 | 145 | EXAMPLE |
| 2-2 | 2B | 90 | M | 10 | 10 | 355 | 650 | 29 | 55 | 730 | 810 | 375 | 160 | 140 | EXAMPLE |
| 2-3 | 2B | 0 | P, B, M | 7 | 100 | 670 | 720 | 11 | 93 | 730 | 750 | 60 | 30 | 70 | COMPARATIVE EXAMPLE |
| 2-4 | 2B | 100 | — | 0 | 0 | 650 | 660 | 11 | 98 | 680 | 685 | 30 | 25 | 60 | COMPARATIVE EXAMPLE |
| 2-5 | 2C | 92 | M | 8 | 8 | 350 | 640 | 30 | 55 | 710 | 790 | 360 | 150 | 140 | EXAMPLE |
| 2-6 | 2D | 91 | M | 9 | 9 | 360 | 660 | 28 | 55 | 730 | 805 | 370 | 145 | 135 | EXAMPLE |
| 2-7 | 2E | 92 | M | 8 | 8 | 290 | 520 | 36 | 56 | 480 | 540 | 190 | 20 | 60 | COMPARATIVE EXAMPLE |
| 2-8 | 2F | 97 | M | 3 | 3 | 320 | 580 | 33 | 55 | 650 | 720 | 330 | 140 | 150 | EXAMPLE |
| 2-9 | 2G | 97 | M | 3 | 3 | 320 | 600 | 32 | 55 | 670 | 745 | 340 | 145 | 145 | EXAMPLE |

F: FERRITE
M: MARTENSITE
P: PEARLITE
B: BAINITE

All Examples of the invention showed a low yield strength YS, a high elongation El, a low yield ratio YR, and a high hole expanding ratio λ, suggesting that the hot-rolled steel sheets have an excellent press-formability including stretch flanging formability, and showed a very large ΔTS, suggesting to have an excellent strain age hardening property. Comparative Examples outside the scope of the invention, in contrast, suggest that the samples are hot-rolled steel sheets having decreased press-formability and strain age hardening property as having a high yield strength YS, a low elongation El, a small hole-expanding ratio λ, or a low ΔTS,.

Example 4

Molten steel having the chemical composition as shown in Table 10 was made in a converter and cast into steel slabs by the continuous casting process. These steel slabs were reheated to 1,250° C., and hot-rolled in a hot rolling step for hot rolling with a finish rolling end temperature of 900° C. and a coiling temperature of 600° C. into hot-rolled steel strips (hot-rolled sheets) having a thickness of 4.0 mm. Then, these hot-rolled steel strips (hot-rolled sheets) were subjected to a cold rolling step of pickling and cold-rolling into cold rolled steel strips (cold-rolled sheets) having a thickness of 1.2 mm. Then, recrystallization annealing was applied to these cold-rolled steel strips (cold-rolled sheets) on a continuous annealing line at an annealing temperature shown in Table 11. The resultant steel strips (cold-rolled annealed sheets) were further subjected to temper rolling of an elongation of 0.8%.

Test pieces were sampled from the resultant steel strips, and microstructure, tensile properties, strain age hardening property and hole expanding property were investigated, as in Example 1. Press-formability was evaluated in terms of elongation, yield strength and hole expanding ratio.

The results are shown in Table 12.

TABLE 10

| STEEL | CHEMICAL COMPOSITION (wt. %) | | | | | | | | | | | | | TRANSFORMATION POINT (° C.) | |
|---|---|---|---|---|---|---|---|---|---|---|---|---|---|---|---|
| NO. | C | Si | Mn | P | S | Al | N | Cr | Mo | W | Nb | Ti | V | $A_{c1}$ | $A_{c3}$ |
| 2H | 0.055 | 0.02 | 1.52 | 0.01 | 0.004 | 0.032 | 0.002 | 0.15 | 0.45 | — | — | — | — | 720 | 880 |
| 2I | 0.058 | 0.02 | 1.56 | 0.01 | 0.002 | 0.032 | 0.002 | — | 0.32 | — | 0.04 | — | 0.05 | 715 | 875 |
| 2J | 0.052 | 0.03 | 1.48 | 0.01 | 0.005 | 0.028 | 0.002 | — | 0.48 | — | 0.05 | 0.03 | — | 720 | 885 |
| 2K | 0.049 | 0.02 | 1.86 | 0.01 | 0.005 | 0.033 | 0.002 | — | — | 0.54 | — | — | — | 715 | 875 |
| 2L | 0.052 | 0.02 | 1.62 | 0.01 | 0.004 | 0.032 | 0.002 | — | 0.35 | — | — | 0.05 | — | 715 | 880 |
| 2M | 0.052 | 0.02 | 1.52 | 0.01 | 0.003 | 0.031 | 0.002 | 0.50 | — | — | 0.05 | — | — | 710 | 885 |
| 2N | 0.053 | 0.02 | 1.88 | 0.01 | 0.004 | 0.032 | 0.002 | — | — | — | — | — | — | 705 | 830 |
| 2P | 0.052 | 0.02 | 1.66 | 0.01 | 0.004 | 0.033 | 0.00 | 0.55 | — | — | — | — | — | 705 | 880 |
| 2Q | 0.055 | 0.02 | 1.49 | 0.01 | 0.003 | 0.031 | 0.00 | — | 0.55 | — | — | — | — | 710 | 880 |
| 2R | 0.049 | 0.02 | 1.73 | 0.01 | 0.002 | 0.032 | 0.00 | — | 0.38 | 0.11 | — | — | — | 710 | 885 |
| 2S | 0.032 | 0.02 | 1.72 | 0.01 | 0.003 | 0.031 | 0.002 | 0.45 | — | 0.15 | 0.04 | — | — | 705 | 855 |
| 2T | 0.033 | 0.02 | 1.65 | 0.01 | 0.004 | 0.032 | 0.002 | 0.52 | — | 0.25 | 0.03 | 0.05 | 0.04 | 706 | 850 |

TABLE 11

| | | HOT ROLLING STEP | | | COLD | |
|---|---|---|---|---|---|---|
| STEEL SHEET NO. | STEEL NO. | SLAB REHEATING TEMP. (° C.) | FINISH ROLLING END TEMP. FDT ° C. | COILING TEMP. CT ° C. | ROLLING STEP COLD ROLLING REDUCTION % | RECRYSTALLIZATION ANNEALING ANNEALING TEMP. (° C.) |
| 2-10 | 2H | 1250 | 900 | 600 | 70 | 800 |
| 2-11 | 2I | | | | | 800 |
| 2-12 | 2I | | | | | 980 |
| 2-13 | 2I | | | | | 680 |
| 2-14 | 2J | | | | | 800 |
| 2-15 | 2K | | | | | 800 |
| 2-16 | 2L | | | | | 800 |
| 2-17 | 2M | | | | | 800 |
| 2-18 | 2N | | | | | 800 |
| 2-19 | 2P | | | | | 800 |
| 2-20 | 2Q | | | | | 800 |
| 2-21 | 2R | | | | | 800 |
| 2-22 | 2S | | | | | 800 |
| 2-23 | 2T | | | | | 800 |

TABLE 12

| STEEL | | MICROSTRUCTURE | | | | COLD-ROLLED SHEET PROPERTIES | | | | PROPERTIES AFTER PRE-STRAIN - HEAT TREATMENT | | STRAIN AGE HARDENING PROPERTIES | | HOLE EXPANSION HOLE EXPANDING | |
|---|---|---|---|---|---|---|---|---|---|---|---|---|---|---|---|
| | | FERRITE | SECONDARY PHASE | | | TENSILE PROPERTIES | | | | | | | | | |
| SHEET NO. | STEEL NO. | AREA RATIO % | KIND | MARTENSITE AREA RATIO % | AREA RATIO % | YS (MPa) | TS (MPa) | El (%) | YR % | $YS_{HT}$ MPa | $TS_{HT}$ MPa | ΔYS MPa | ΔTS MPa | RATIO λ % | RE-MARKS |
| 2-10 | 2H | 92 | M | 8 | 8 | 335 | 610 | 31 | 55 | 675 | 750 | 340 | 140 | 125 | EXAM-PLE |

TABLE 12-continued

| STEEL SHEET NO. | STEEL NO. | MICROSTRUCTURE FERRITE AREA RATIO % | SECONDARY PHASE KIND | SECONDARY PHASE MARTENSITE AREA RATIO % | SECONDARY PHASE AREA RATIO % | COLD-ROLLED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 2-11 | 2I | 90 | M | 10 | 10 | 355 | 640 | 30 | 55 | 710 | 790 | 355 | 150 | 140 | EXAMPLE |
| 2-12 | 2I | 0 | P, B, M | 8 | 100 | 670 | 720 | 11 | 93 | 680 | 740 | 10 | 20 | 70 | COMPARATIVE EXAMPLE |
| 2-13 | 2I | 100 | — | 0 | 0 | 620 | 640 | 12 | 97 | 640 | 655 | 20 | 15 | 60 | COMPARATIVE EXAMPLE |
| 2-14 | 2J | 92 | M | 8 | 8 | 340 | 620 | 31 | 55 | 680 | 760 | 340 | 140 | 135 | EXAMPLE |
| 2-15 | 2K | 90 | M | 10 | 10 | 345 | 610 | 30 | 57 | 670 | 745 | 325 | 135 | 120 | EXAMPLE |
| 2-16 | 2L | 92 | M | 8 | 8 | 350 | 630 | 30 | 56 | 670 | 740 | 320 | 110 | 130 | EXAMPLE |
| 2-17 | 2M | 94 | M | 6 | 6 | 330 | 600 | 32 | 55 | 660 | 730 | 330 | 130 | 130 | EXAMPLE |
| 2-18 | 2N | 93 | M | 7 | 7 | 330 | 600 | 31 | 55 | 550 | 610 | 220 | 10 | 70 | COMPARATIVE EXAMPLE |
| 2-19 | 2P | 93 | M | 7 | 7 | 340 | 620 | 31 | 55 | 660 | 740 | 320 | 120 | 120 | EXAMPLE |
| 2-20 | 2Q | 95 | M | 5 | 5 | 350 | 630 | 30 | 56 | 680 | 750 | 330 | 120 | 125 | EXAMPLE |
| 2-21 | 2R | 92 | M | 8 | 8 | 335 | 610 | 31 | 55 | 665 | 745 | 330 | 135 | 120 | EXAMPLE |
| 2-22 | 2S | 94 | M | 6 | 6 | 355 | 640 | 30 | 55 | 690 | 770 | 335 | 130 | 140 | EXAMPLE |
| 2-23 | 2T | 93 | M | 7 | 7 | 340 | 620 | 30 | 55 | 665 | 750 | 325 | 130 | 130 | EXAMPLE |

F: FERRITE
M: MARTENSITE
P: PEARLITE
B: BAINITE

All Examples of the invention showed a low yield strength YS, a high elongation El, a low yield ratio YR, and a high hole expanding ratio λ, suggesting that these hot-rolled steel sheets have an excellent press-formability including stretch flanging formability, and showed a very large ΔTS, suggesting to have an excellent strain age hardening property. Comparative Examples outside the scope of the invention, in contrast, suggest that the samples are hot-rolled steel sheets having a low ΔTS, decreased press-formability and strain age hardening property as having a high yield strength YS, a low elongation El, a small hole expanding ratio λ.

Example 5

Molten steel having the chemical composition as shown in Table 13 was made in a converter and cast into steel slabs by the continuous casting process. These steel slabs were hot-rolled under the conditions shown in Table 14 into hot-rolled steel strips (hot-rolled sheets). Steel sheet No. 3-3 was lubrication-rolled on the latter four stands of finish rolling. After pickling, these hot-rolled steel strips (hot-rolled sheet) were annealed on a continuous hot-dip galvanizing line (CGL) under the conditions shown in Table 14, and then subjected to a hot-dip galvanizing treatment, thereby forming a hot-dip galvanizing layer on the surface of the steel sheet. Then, an alloying treatment of the hot-dip galvanizing layer was applied under the conditions shown in Table 14. Some of the steel sheets were left as hot-dip galvanized.

After further pickling, the hot-rolled steel strips (hot-rolled sheets) were subjected to a cold rolling step under the conditions shown in Table 14 into cold-rolled steel strips (cold-rolled sheets). These cold-rolled steel strips (cold-rolled sheets) were annealed under the conditions shown in Table 14 on a continuous hot-dip galvanizing line (CGL), and then subjected to a hot-dip galvanizing treatment to form a hot-dip galvanizing layer on the surface of the steel sheets. Then, an alloying treatment of the hot-dip galvanizing layer was applied under the conditions shown in Table 14. Some of the steel sheets were left as hot-dip-galvanized.

Prior to annealing on the continuous hot-dip galvanizing line (CGL), some of the steel sheets were subjected to a preheating treatment under the conditions shown in Table 14, and then to a pretreatment steel for pickling. Pickling in the pretreatment step was conducted in a pickling tank on the entry side of CGL.

The galvanizing bath temperature was within a range of from 460 to 480° C., and the temperature of the steel sheets to be dipped was within a range of from the galvanizing bath temperature to (bath temperature+10° C.). In the alloying treatment, the sheets were reheated to the alloying temperature, and held at the temperature for a period of from 15 to 28 seconds. These steel sheets were further subjected to temper rolling of an elongation of 1.0%.

For the hot-dip galvanized steel sheets (steel strips) obtained through the above-mentioned steps, microstructure, tensile properties, strain age hardening property, and hole expanding ratio were determined as in Example 1. Press-formability was evaluated in terms of elongation El, yield strength and hole-expanding ratio.

The results are shown in Table 15.

TABLE 13

| STEEL | CHEMICAL COMPOSITION (wt. %) | | | | | | | | | | | | | | TRANSFORMATION POINT (° C.) | |
|---|---|---|---|---|---|---|---|---|---|---|---|---|---|---|---|---|
| NO. | C | Si | Mn | P | S | Al | N | Cu | Ni | Cr | Mo | Nb | Ti | V | $A_{c1}$ | $A_{c3}$ |
| 3A | 0.034 | 0.02 | 1.70 | 0.01 | 0.004 | 0.034 | 0.002 | 1.50 | — | — | — | — | — | — | 705 | 842 |
| 3B | 0.037 | 0.02 | 1.56 | 0.01 | 0.001 | 0.033 | 0.002 | 1.45 | 0.60 | — | 0.12 | — | — | — | 711 | 848 |
| 3C | 0.041 | 0.03 | 1.45 | 0.01 | 0.005 | 0.029 | 0.002 | 1.28 | 0.51 | 0.13 | — | — | — | — | 711 | 847 |
| 3D | 0.038 | 0.02 | 1.60 | 0.01 | 0.005 | 0.032 | 0.002 | 0.35 | 0.43 | — | — | 0.01 | 0.01 | 0.01 | 707 | 845 |
| 3E | 0.037 | 0.02 | 1.80 | 0.01 | 0.006 | 0.034 | 0.002 | 0.14 | — | — | — | — | — | — | 706 | 835 |
| 3F | 0.035 | 0.02 | 1.66 | 0.01 | 0.003 | 0.033 | 0.002 | 0.72 | — | — | — | — | — | — | 706 | 844 |
| 3G | 0.036 | 0.02 | 1.68 | 0.01 | 0.005 | 0.036 | 0.002 | 0.96 | — | — | — | — | — | — | 706 | 843 |

TABLE 14

| STEEL | | | HOT ROLLING STEP | | | COLD ROLLING STEP | | PRETREATMENT STEP | | |
|---|---|---|---|---|---|---|---|---|---|---|
| | | | FINISH ROLLING | | | COLD | | | | |
| STEEL SHEET NO. | STEEL NO. | SLAB REHEATING TEMP. (° C.) | END TEMP. FDT ° C. | COILING TEMP. CT ° C. | FINAL THICKNESS mm | ROLLING REDUCTION % | FINAL THICKNESS mm | PREHEATING TREATMENT LINE | PREHEATING TREATMENT TEMP. ° C. | PICKLING YES/NO |
| 3-1 | 3A | 1150 | 850 | 600 | 1.6 | — | — | — | — | — |
| 3-2 | 3B | 1150 | 850 | 600 | 1.6 | — | — | — | — | — |
| 3-3 | 3B | | | | | | | CAL | 800 | YES |
| 3-4 | 3B | | | | | | | — | — | — |
| 3-5 | 3B | | | | | | | — | — | — |
| 3-6 | 3C | 1150 | 850 | 600 | 1.6 | — | — | — | — | — |
| 3-7 | 3D | 1150 | 850 | 600 | 1.6 | — | — | — | — | — |
| 3-8 | 3E | 1150 | 850 | 600 | 1.6 | — | — | — | — | — |
| 3-9 | 3F | 1150 | 850 | 600 | 1.6 | — | — | — | — | — |
| 3-10 | 3G | 1150 | 850 | 600 | 1.6 | — | — | — | — | — |
| 3-11 | 3A | 1150 | 850 | 600 | 4.0 | 70 | 1.2 | — | — | — |
| 3-12 | 3B | 1150 | 850 | 600 | 4.0 | 70 | 1.2 | — | — | — |
| 3-13 | 3B | | | | | | | CAL | 800 | YES |
| 3-14 | 3B | | | | | | | — | — | — |
| 3-15 | 3B | | | | | | | — | — | — |
| 3-16 | 3C | 1150 | 850 | 600 | 4.0 | 70 | 1.2 | — | — | — |
| 3-17 | 3D | 1150 | 850 | 600 | 4.0 | 70 | 1.2 | — | — | — |
| 3-18 | 3E | 1150 | 850 | 600 | 4.0 | 70 | 1.2 | — | — | — |
| 3-19 | 3F | 1150 | 850 | 600 | 4.0 | 70 | 1.2 | — | — | — |
| 3-20 | 3G | 1150 | 850 | 600 | 4.0 | 70 | 1.2 | — | — | — |

| | ANNEALING | | | | | |
|---|---|---|---|---|---|---|
| STEEL SHEET NO. | STEEL NO. | KIND OF LINE | HEATING TEMP. ° C. | PLATING | ALLOYING TEMP. ° C. | TEMPER ROLLING REDUCTION % |
| 3-1 | 3A | CGL | 800 | ALLOYING | 510 | 1.0 |
| 3-2 | 3B | CGL | 800 | | | 1.0 |
| 3-3 | 3B | CGL | 780 | | | 1.0 |
| 3-4 | 3B | CGL | 980 | | | 1.0 |
| 3-5 | 3B | CGL | 680 | | | 1.0 |

TABLE 14-continued

| | | | | | | |
|---|---|---|---|---|---|---|
| 3-6 | 3C | CGL | 800 | NON-ALLOYING | — | 1.0 |
| 3-7 | 3D | CGL | 800 | ALLOYING | 520 | 1.0 |
| 3-8 | 3E | CGL | 800 | | | 1.0 |
| 3-9 | 3F | CGL | 800 | | | 1.0 |
| 3-10 | 3G | CGL | 800 | ALLOYING | 510 | 1.0 |
| 3-11 | 3A | CGL | 800 | | | 1.0 |
| 3-12 | 3B | CGL | 800 | | | 1.0 |
| 3-13 | 3B | CGL | 780 | | | 1.0 |
| 3-14 | 3B | CGL | 980 | | | 1.0 |
| 3-15 | 3B | CGL | 680 | | | 1.0 |
| 3-16 | 3C | CGL | 800 | | | 1.0 |
| 3-17 | 3D | CGL | 800 | | | 1.0 |
| 3-18 | 3E | CGL | 800 | | | 1.0 |
| 3-19 | 3F | CGL | 800 | NON-ALLOYING | — | 1.0 |
| 3-20 | 3G | CGL | 800 | NON-ALLOYING | — | 1.0 |

TABLE 15

| STEEL | | MICROSTRUCTURE | | | | PLATED SHEET PROPERTIES | | | | PROPERTIES AFTER PRE-STRAIN - HEAT TREATMENT | | STRAIN AGE HARDENING PROPERTIES | | HOLE EXPANSION HOLE EXPANDING | |
|---|---|---|---|---|---|---|---|---|---|---|---|---|---|---|---|
| | | FERRITE AREA | SECONDARY PHASE* | | AREA | TENSILE PROPERTIES | | | | | | | | | |
| SHEET NO. | STEEL NO. | RATIO % | KIND | MARTENSITE % | RATIO % | YS (MPa) | TS (MPa) | El (%) | YR % | $YS_{HT}$ MPa | $TS_{HT}$ MPa | ΔYS MPa | ΔTS MPa | RATIO λ % | REMARKS |
| 3-1 | 3A | 94 | M | 6 | 6 | 340 | 620 | 30 | 55 | 690 | 765 | 350 | 145 | 140 | EXAMPLE |
| 3-2 | 3B | 91 | M | 9 | 9 | 355 | 640 | 29 | 55 | 720 | 795 | 365 | 155 | 135 | EXAMPLE |
| 3-3 | 3B | 91 | M | 9 | 9 | 340 | 620 | 30 | 55 | 690 | 775 | 350 | 155 | 135 | EXAMPLE |
| 3-4 | 3B | 0 | M, P, B | 6 | 100 | 670 | 710 | 12 | 94 | 720 | 740 | 50 | 30 | 65 | COMPARATIVE EXAMPLE |
| 3-5 | 3B | 100 | — | 0 | 0 | 630 | 650 | 11 | 97 | 670 | 675 | 40 | 25 | 55 | COMPARATIVE EXAMPLE |
| 3-6 | 3C | 93 | M | 7 | 7 | 350 | 630 | 29 | 56 | 680 | 775 | 330 | 145 | 135 | EXAMPLE |
| 3-7 | 3D | 92 | M | 8 | 8 | 360 | 650 | 28 | 55 | 710 | 795 | 350 | 145 | 130 | EXAMPLE |
| 3-8 | 3E | 93 | M | 7 | 7 | 290 | 510 | 36 | 57 | 470 | 530 | 180 | 20 | 60 | COMPARATIVE EXAMPLE |
| 3-9 | 3F | 96 | M | 4 | 4 | 310 | 570 | 33 | 54 | 640 | 710 | 330 | 140 | 140 | EXAMPLE |
| 3-10 | 3G | 95 | M | 5 | 5 | 320 | 590 | 32 | 54 | 660 | 735 | 340 | 145 | 135 | EXAMPLE |
| 3-11 | 3A | 92 | M | 8 | 8 | 345 | 630 | 31 | 55 | 700 | 780 | 355 | 150 | 145 | EXAMPLE |
| 3-12 | 3B | 90 | M | 10 | 10 | 360 | 660 | 29 | 55 | 730 | 820 | 370 | 160 | 140 | EXAMPLE |
| 3-13 | 3B | 90 | M | 10 | 10 | 350 | 640 | 30 | 55 | 720 | 800 | 370 | 160 | 140 | EXAMPLE |
| 3-14 | 3B | 0 | M, P, B | 8 | 100 | 680 | 720 | 12 | 94 | 730 | 750 | 50 | 30 | 70 | COMPARATIVE EXAMPLE |
| 3-15 | 3B | 100 | — | 0 | 0 | 640 | 660 | 11 | 97 | 660 | 685 | 20 | 25 | 60 | COMPARATIVE EXAMPLE |

TABLE 15-continued

| STEEL SHEET NO. | STEEL NO. | MICROSTRUCTURE FERRITE AREA RATIO % | SECONDARY PHASE* KIND | MARTENSITE % | AREA RATIO % | PLATED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 3-16 | 3C | 91 | M | 9 | 9 | 355 | 650 | 30 | 55 | 720 | 800 | 365 | 150 | 140 | EXAMPLE |
| 3-17 | 3D | 91 | M | 9 | 9 | 360 | 660 | 29 | 55 | 720 | 805 | 360 | 145 | 135 | EXAMPLE |
| 3-18 | 3E | 93 | M | 7 | 7 | 290 | 520 | 36 | 56 | 480 | 540 | 190 | 20 | 60 | COMPARATIVE EXAMPLE |
| 3-19 | 3F | 97 | M | 3 | 3 | 320 | 580 | 34 | 55 | 640 | 715 | 320 | 135 | 135 | EXAMPLE |
| 3-20 | 3G | 96 | M | 4 | 4 | 330 | 600 | 33 | 55 | 670 | 740 | 70 | 140 | 140 | EXAMPLE |

*M: MARTENSITE,
P: PEARLITE,
B: BAINITE

All Examples of the invention showed a low yield strength YS, a high elongation El, a low yield ratio YR, and a high hole-expanding ratio λ, suggesting that these hot-rolled steel sheets have an excellent press-formability including stretch flanging formability, and showed a high ΔYS, and a very large ΔTS, suggesting to have an excellent strain age hardening property. Comparative Examples outside the scope of the invention, in contrast, suggest that the samples are hot-rolled steel sheets having decreased press-formability and strain age hardening property as having a high yield strength YS, a low elongation El, a small hole expanding ratio λ, or a low ΔTS,.

Example 6

Molten steel having the chemical composition as shown in Table 16 was made in a converter and cast into steel slabs by the continuous casting process. These steel slabs were hot-rolled under the conditions shown in Table 17 into hot-rolled steel strips (hot-rolled sheets) having a thickness of 1.6 or 4.0 mm. After pickling, the hot-rolled steel strips having a thickness of 1.6 mm were annealed under the conditions shown in Table 17 on a continuous hot-dip galvanizing line (CGL), and the subjected to a hot-dip galvanizing treatment, thereby forming a hot-dip galvanizing layer on the surface of each steel sheet. Then, an alloying treatment of the hot-dip galvanizing layer was applied under the conditions shown in Table 17. Some of the steel sheets were left as hot-dip galvanized.

After further pickling, the hot-rolled steel strips (hot-rolled sheets) were cold-rolled under the conditions shown in Table 17 into cold-rolled steel strips (cold-rolled sheets). These cold-rolled steel strips (cold-rolled sheets) were annealed under the conditions shown in Table 17 on a continuous hot-dip galvanizing line (CGL), and then, subjected to a hot-dip galvanizing treatment, thereby forming a hot-dip galvanizing layer on the surface of each steel sheet. Then, an alloying treatment of the hot-dip galvanizing layer was applied. Some of the steel sheets were left as hot-dip galvanized.

Prior to annealing of the continuous hot-dip galvanizing line (CGL), some of the steel sheets were subjected to a preheating treatment under the conditions shown in Table 17 on a continuous annealing line (CAL), and a pretreatment step for pickling. Pickling in the pretreatment step was accomplished in a pickling tank on the entry side of CGL.

The galvanizing bath temperature was within a range of from 460 to 480° C., and the temperature of the steel sheets to be dipped was within a range of from the galvanizing bath temperature to (bath temperature+10° C.). In the alloying treatment, the sheets were reheated to the alloying temperature, and held at the temperature for a period of from 15 to 28 seconds. These steel sheets were further subjected to temper rolling of an elongation of 1.0%.

For the hot-dip galvanized steel sheets (steel strips) obtained through the above-mentioned steps, microstructure, tensile properties, strain age hardening property, and hole expanding ratio were determined as in Example 1. Press-formability was evaluated in terms of elongation El, yield strength and hole expanding ratio.

The results are shown in Table 18.

TABLE 16

| STEEL | CHEMICAL COMPOSITION (wt. %) | | | | | | | | | | | | | TRANSFORMATION POINT (° C.) | |
|---|---|---|---|---|---|---|---|---|---|---|---|---|---|---|---|
| NO. | C | Si | Mn | P | S | Al | N | Cr | Mo | W | Nb | Ti | V | $A_{c1}$ | $A_{c3}$ |
| 3H | 0.054 | 0.02 | 1.56 | 0.01 | 0.004 | 0.034 | 0.002 | 0.15 | 0.43 | — | — | — | — | 715 | 870 |
| 3I | 0.048 | 0.02 | 1.52 | 0.01 | 0.002 | 0.033 | 0.002 | — | 0.32 | — | 0.04 | — | 0.05 | 715 | 875 |
| 3J | 0.051 | 0.03 | 1.55 | 0.01 | 0.005 | 0.029 | 0.002 | — | 0.48 | — | 0.05 | 0.03 | — | 715 | 885 |
| 3K | 0.055 | 0.02 | 1.86 | 0.01 | 0.005 | 0.033 | 0.002 | — | — | 0.51 | — | — | — | 715 | 870 |
| 3L | 0.056 | 0.02 | 1.61 | 0.01 | 0.001 | 0.034 | 0.002 | — | 0.33 | — | — | 0.05 | — | 710 | 880 |
| 3M | 0.052 | 0.02 | 1.52 | 0.01 | 0.003 | 0.033 | 0.002 | 0.50 | — | — | 0.05 | — | — | 710 | 875 |
| 3N | 0.054 | 0.02 | 1.88 | 0.01 | 0.005 | 0.032 | 0.002 | — | — | — | — | — | — | 705 | 830 |
| 3P | 0.052 | 0.02 | 1.66 | 0.01 | 0.005 | 0.031 | 0.002 | 0.52 | — | — | — | — | — | 705 | 870 |
| 3Q | 0.051 | 0.02 | 1.63 | 0.01 | 0.004 | 0.032 | 0.002 | — | 0.53 | — | — | — | — | 710 | 870 |
| 3R | 0.055 | 0.02 | 1.81 | 0.01 | 0.003 | 0.029 | 0.002 | — | 0.33 | 0.22 | — | — | — | 715 | 875 |
| 3S | 0.053 | 0.02 | 1.74 | 0.01 | 0.005 | 0.033 | 0.002 | 0.42 | — | 0.12 | 0.04 | — | — | 715 | 870 |
| 3T | 0.053 | 0.02 | 1.62 | 0.01 | 0.002 | 0.034 | 0.002 | 0.29 | — | 0.22 | 0.03 | 0.02 | 0.04 | 715 | 875 |

TABLE 17

| STEEL | | | HOT ROLLING STEP | | | COLD ROLLING STEP | | PRETREATMENT STEP | | |
|---|---|---|---|---|---|---|---|---|---|---|
| STEEL SHEET NO. | STEEL NO. | SLAB REHEATING TEMP. (° C.) | FINISH ROLLING END TEMP. FDT ° C. | COILING TEMP. CT ° C. | FINAL THICKNESS mm | COLD ROLLING REDUCTION % | FINAL THICKNESS mm | PREHEATING TREATMENT LINE | PREHEATING TREATMENT TEMP. ° C. | PICKLING YES/NO |
| 3-21 | 3H | 1250 | 850 | 600 | 1.6 | — | — | — | — | — |
| 3-22 | 3I | 1250 | 850 | 600 | 1.6 | — | — | — | — | — |
| 3-23 | | | | | | | | CAL | 800 | YES |
| 3-24 | | | | | | | | — | — | — |
| 3-25 | | | | | | | | — | — | — |
| 3-26 | 3J | 1250 | 850 | 600 | 1.6 | — | — | — | — | — |
| 3-27 | 3K | 1250 | 850 | 600 | 1.6 | — | — | — | — | — |
| 3-28 | 3L | 1250 | 850 | 600 | 1.6 | — | — | — | — | — |
| 3-29 | 3M | 1250 | 850 | 600 | 1.6 | — | — | — | — | — |
| 3-30 | 3N | 1250 | 850 | 600 | 1.6 | — | — | — | — | — |
| 3-31 | 3H | 1250 | 850 | 600 | 4.0 | 70 | 1.2 | — | — | — |
| 3-32 | 3I | 1250 | 850 | 600 | 4.0 | 70 | 1.2 | — | — | — |
| 3-33 | | | | | | | | CAL | 800 | YES |
| 3-34 | | | | | | | | — | — | — |
| 3-35 | | | | | | | | — | — | — |
| 3-36 | 3J | 1250 | 850 | 600 | 4.0 | 70 | 1.2 | — | — | — |
| 3-37 | 3K | 1250 | 850 | 600 | 4.0 | 70 | 1.2 | — | — | — |
| 3-38 | 3L | 1250 | 850 | 600 | 4.0 | 70 | 1.2 | — | — | — |
| 3-39 | 3M | 1250 | 850 | 600 | 4.0 | 70 | 1.2 | — | — | — |
| 3-40 | 3N | 1250 | 850 | 600 | 4.0 | 70 | 1.2 | — | — | — |
| 3-41 | 3P | 1250 | 850 | 600 | 4.0 | 70 | 1.2 | — | — | — |
| 3-42 | 3Q | 1250 | 850 | 600 | 4.0 | 70 | 1.2 | — | — | — |
| 3-43 | 3R | 1250 | 850 | 600 | 4.0 | 70 | 1.2 | — | — | — |
| 3-44 | 3S | 1250 | 850 | 600 | 4.0 | 70 | 1.2 | — | — | — |
| 3-45 | 3T | 1250 | 850 | 600 | 4.0 | 70 | 1.2 | — | — | — |

| | ANNEALING | | | | | |
|---|---|---|---|---|---|---|
| STEEL SHEET NO. | STEEL NO. | KIND OF LINE | HEATING TEMP. ° C. | PLATING | ALLOYING TEMP. ° C. | TEMPER ROLLING REDUCTION % |
| 3-21 | 3H | CGL | 800 | ALLOYING | 510 | 1.0 |
| 3-22 | 3I | CGL | 800 | | | 1.0 |
| 3-23 | | CGL | 780 | | | 1.0 |
| 3-24 | | CGL | 980 | | | 1.0 |
| 3-25 | | CGL | 680 | | | 1.0 |
| 3-26 | 3J | CGL | 800 | NON-ALLOYING | — | 1.0 |
| 3-27 | 3K | CGL | 800 | NON-ALLOYING | — | 1.0 |
| 3-28 | 3L | CGL | 800 | ALLOYING | 520 | 1.0 |
| 3-29 | 3M | CGL | 800 | | | 1.0 |
| 3-30 | 3N | CGL | 800 | | | 1.0 |

TABLE 17-continued

| | | | | | | |
|---|---|---|---|---|---|---|
| 3-31 | 3H | CGL | 800 | ALLOYING | 510 | 1.0 |
| 3-32 | 3I | CGL | 800 | | | 1.0 |
| 3-33 | | CGL | 780 | | | 1.0 |
| 3-34 | | CGL | 980 | | | 1.0 |
| 3-35 | | CGL | 680 | | | 1.0 |
| 3-36 | 3J | CGL | 800 | ALLOYING | 520 | 1.0 |
| 3-37 | 3K | CGL | 800 | | | 1.0 |
| 3-38 | 3L | CGL | 800 | | | 1.0 |
| 3-39 | 3M | CGL | 800 | | | 1.0 |
| 3-40 | 3N | CGL | 800 | | | 1.0 |
| 3-41 | 3P | CGL | 800 | | | 1.0 |
| 3-42 | 3Q | CGL | 800 | | | 1.0 |
| 3-43 | 3R | CGL | 800 | NON-ALLOYING | — | 1.0 |
| 3-44 | 3S | CGL | 800 | NON-ALLOYING | — | 1.0 |
| 3-45 | 3T | CGL | 800 | ALLOYING | 520 | 1.0 |

TABLE 18

| | | MICROSTRUCTURE | | | | PLATED SHEET PROPERTIES | | | | PROPERTIES AFTER PRE-STRAIN - HEAT TREATMENT | | STRAIN AGE HARDENING PROPERTIES | | HOLE EXPANSION HOLE EXPANDING | |
|---|---|---|---|---|---|---|---|---|---|---|---|---|---|---|---|
| | | FERRITE | SECONDARY PHASE* | | | TENSILE PROPERTIES | | | | | | | | | |
| STEEL SHEET NO. | STEEL NO. | AREA RATIO % | KIND | MARTENSITE % | AREA RATIO % | YS (MPa) | TS (MPa) | El (%) | YR % | $YS_{HT}$ MPa | $TS_{HT}$ MPa | ΔYS MPa | ΔTS MPa | RATIO λ % | REMARKS |
| 3-21 | 3H | 93 | M | 7 | 7 | 335 | 610 | 30 | 55 | 671 | 745 | 336 | 135 | 120 | EXAMPLE |
| 3-22 | 3I | 90 | M | 10 | 10 | 350 | 640 | 29 | 55 | 707 | 785 | 357 | 145 | 140 | EXAMPLE |
| 3-23 | 3I | 90 | M | 10 | 10 | 340 | 620 | 30 | 55 | 689 | 765 | 349 | 145 | 140 | EXAMPLE |
| 3-24 | 3I | 0 | M, P, B | 7 | 100 | 665 | 710 | 12 | 94 | 710 | 730 | 45 | 20 | 60 | COMPARATIVE EXAMPLE |
| 3-25 | 3I | 100 | — | 0 | 0 | 560 | 580 | 11 | 97 | 590 | 595 | 30 | 15 | 70 | COMPARATIVE EXAMPLE |
| 3-26 | 3J | 92 | M | 8 | 8 | 350 | 620 | 29 | 56 | 680 | 755 | 330 | 135 | 135 | EXAMPLE |
| 3-27 | 3K | 91 | M | 9 | 9 | 335 | 610 | 28 | 55 | 671 | 745 | 336 | 135 | 120 | EXAMPLE |
| 3-28 | 3L | 92 | M | 8 | 8 | 360 | 630 | 36 | 57 | 681 | 745 | 321 | 115 | 135 | EXAMPLE |
| 3-29 | 3M | 95 | M | 5 | 5 | 325 | 600 | 33 | 54 | 657 | 730 | 332 | 130 | 140 | EXAMPLE |
| 3-30 | 3N | 94 | M | 6 | 6 | 325 | 600 | 32 | 54 | 554 | 615 | 229 | 15 | 70 | COMPARATIVE EXAMPLE |
| 3-31 | 3H | 91 | M | 9 | 9 | 340 | 620 | 31 | 55 | 684 | 760 | 344 | 140 | 120 | EXAMPLE |
| 3-32 | 3I | 90 | M | 10 | 10 | 360 | 650 | 29 | 55 | 720 | 800 | 360 | 150 | 135 | EXAMPLE |
| 3-33 | 3I | 90 | M | 10 | 10 | 345 | 630 | 30 | 55 | 702 | 780 | 357 | 150 | 130 | EXAMPLE |
| 3-34 | 3I | 0 | M, P, B | 8 | 100 | 675 | 720 | 12 | 94 | 720 | 740 | 45 | 20 | 70 | COMPARATIVE EXAMPLE |
| 3-35 | 3I | 100 | — | 0 | 0 | 570 | 590 | 11 | 97 | 590 | 605 | 20 | 15 | 70 | COMPARATIVE EXAMPLE |

TABLE 18-continued

| STEEL SHEET NO. | STEEL NO. | MICROSTRUCTURE FERRITE AREA RATIO % | SECONDARY PHASE* KIND | MARTENSITE % | AREA RATIO % | PLATED SHEET PROPERTIES TENSILE PROPERTIES YS (MPa) | TS (MPa) | El (%) | YR % | PROPERTIES AFTER PRE-STRAIN - HEAT TREATMENT $YS_{HT}$ MPa | $TS_{HT}$ MPa | STRAIN AGE HARDENING PROPERTIES ΔYS MPa | ΔTS MPa | HOLE EXPANSION HOLE EXPANDING RATIO λ % | REMARKS |
|---|---|---|---|---|---|---|---|---|---|---|---|---|---|---|---|
| 3-36 | 3J | 90 | M | 10 | 10 | 345 | 630 | 30 | 55 | 693 | 770 | 348 | 140 | 120 | EXAMPLE |
| 3-37 | 3K | 91 | M | 9 | 9 | 360 | 620 | 29 | 56 | 680 | 755 | 335 | 135 | 125 | EXAMPLE |
| 3-38 | 3L | 92 | M | 8 | 8 | 360 | 640 | 36 | 56 | 685 | 770 | 325 | 130 | 135 | EXAMPLE |
| 3-39 | 3M | 96 | M | 4 | 4 | 335 | 610 | 34 | 55 | 671 | 745 | 336 | 135 | 140 | EXAMPLE |
| 3-40 | 3N | 95 | M | 5 | 5 | 340 | 610 | 33 | 56 | 567 | 630 | 227 | 20 | 70 | COMPARATIVE EXAMPLE |
| 3-41 | 3P | 96 | M | 4 | 4 | 335 | 610 | 30 | 55 | 670 | 745 | 335 | 135 | 125 | EXAMPLE |
| 3-42 | 3Q | 94 | M | 6 | 6 | 340 | 620 | 30 | 55 | 690 | 770 | 350 | 150 | 120 | EXAMPLE |
| 3-43 | 3R | 93 | M | 7 | 7 | 350 | 640 | 29 | 55 | 705 | 785 | 355 | 145 | 120 | EXAMPLE |
| 3-44 | 3S | 95 | M | 5 | 5 | 360 | 650 | 29 | 55 | 680 | 780 | 320 | 130 | 135 | EXAMPLE |
| 3-45 | 3T | 94 | M | 6 | 6 | 340 | 620 | 30 | 55 | 690 | 775 | 340 | 140 | 120 | EXAMPLE |

*M: MARTENSITE,
P: PEARLITE,
B: BAINITE

All Examples of the invention showed a low yield strength YS, a high elongation El, a low yield ratio YR, and a high hole expanding ratio λ, suggesting that these galvanized steel sheets have an excellent press-formability including stretch flanging formability, and showed a high ΔYS, and a very large ΔTS, suggesting to have an excellent strain age hardening property. Comparative Examples outside the scope of the invention, in contrast, suggest that the samples are galvanized steel sheets having decreased press-formability and strain age hardening property as having a high yield strength YS, a low elongation El, a small hole expanding ratio λ, or a low ΔTS,.

Industrial Applicability

According to the present invention, it is possible to stably manufacture hot-rolled steel sheets, cold-rolled steel sheets and plated steel sheets in which tensile strength remarkably increased through a heat treatment applied after press forming while maintaining an excellent press-formability, giving industrially remarkable effects. When applying a steel sheet of the invention to automotive parts, there are available advantages of easy press forming, high and stable parts properties after completion, and sufficient contribution to the weight reduction of the automobile body.

What is claimed is:

1. A steel sheet excellent in press-formability and in strain age hardening property as represented by a ΔTS of 80 MPa or more, comprising a structure having ferrite phase as a main phase forming a composite structure with a secondary phase containing martensite phase in an area ratio of 2% to 10% and wherein said structure has very fine strain-induced precipitates of Cu, Mo, or W in the martensite after the application of a pre-strain treatment of 5% or more followed by a heat treatment at 150 to 350° C.

2. A steel sheet according to claim 1, which is a hot-rolled steel sheet.

3. A steel sheet according to claim 2, comprising, in weight percentage:

C: 0.15% or less, Si: 2.0% or less, Mn: 3.0% or less, P: 0.1% or less, S: 0.02% or less, Al: 0.1% or less, N: 0.02% or less, Cu: from 0.5 to 3.0%, and the balance Fe an incidental impurities.

4. A steel sheet according to claim 3, containing, in weight percentage, one or more selected from the following groups A to C, in addition to the above-mentioned chemical composition:

group A: Ni: 2.0% or less;

group B: one or two of Cr and Mo: 2.0% or less in total; and group C: one or more of Nb, Ti and V: 0.2% or less in total.

5. A steel sheet according to claim 2, having a chemical composition consisting essentially of, in weight percentage:

C: 0.15% or less, Si: 2.0% or less, Mn: 3.0% or less, P: 0.1% or less, S: 0.02% or less, Al: 0.1% or less, N: 0.02% or less, one or more selected from the group consisting of from 0.05 to 2.0% Mo and from 0.05 to 2.0% W, 2.0% or less in total, and the balance Fe and incidental impurities.

6. A steel sheet according to claim 5, further comprising, in addition to the above-mentioned chemical composition, in weight percentage, one or more elected from the group consisting of Nb, Ti, and V, 2.0% or less in total.

7. A steel sheet according to claim 1, which is a cold-rolled steel sheet.

8. A steel sheet according to claim 7, comprising, in weight percentage:

C: 0.15% or less, Si: 2.0% or less, Mn: 3.0% or less, P: 0.1% or less, S: 0.02% or less, Al: 0.1% or less, N: 0.02% or less, Cu: from 0.5 to 3.0%, and the balance Fe an incidental impurities.

9. A steel sheet according to claim 8, containing, in weight percentage, one or more selected from the following groups A to C, in addition to the above-mentioned chemical composition:

group A: Ni: 2.0% orless;

group B: one or two of Cr and Mo: 2.0% or less in total; and group C: one or more of Nb, Ti and V: 0.2% or less in total.

10. A steel sheet according to claim 7, having a chemical composition consisting essentially of, in weight percentage:

C: 0.15% or less, Si: 2.0% or less, Mn: 3.0% or less, P: 0.1% or less, S: 0.02% or less, Al: 0.1% or less, N: 0.02% or less, one or more selected from the group consisting of form 0.05 to 2.0% Mo and from 0.05 to 2.0% W, 2.0% or less in total, and the balance Fe and incidental impurities.

11. A steel sheet according to claim 10, further comprising, in addition to the above-mentioned chemical composition, in weight percentage, one or more elected from the group consisting of Nb, Ti and V, 2.0% or less in total.

* * * * *

UNITED STATES PATENT AND TRADEMARK OFFICE

CERTIFICATE OF CORRECTION

PATENT NO. : 6,676,774 B2
DATED : January 13, 2004
INVENTOR(S) : Matsuoka et al.

It is certified that error appears in the above-identified patent and that said Letters Patent is hereby corrected as shown below:

Column 41,
Table 9, at No. 2-9, at subheading "YS (MPa)" (first occurrence) please change "320" to -- 330 --.

Column 47,
Table 13, at No. 3D at subheading "Cu" please change "0.35" to -- 1.35 --.

Signed and Sealed this

Fifth Day of April, 2005

JON W. DUDAS
*Director of the United States Patent and Trademark Office*